US010759588B1

(12) United States Patent
Lobisser et al.

(10) Patent No.: US 10,759,588 B1
(45) Date of Patent: Sep. 1, 2020

(54) SYSTEM AND METHOD FOR TRANSPORTING AND STORING POST-HARVEST FRUITS, VEGETABLES AND OTHER PERISHABLE COMMODITIES UNDER CONTROLLED ATMOSPHERIC CONDITIONS

(71) Applicant: RIPELOCKER LLC, Bainbridge Island, WA (US)

(72) Inventors: George Frank Lobisser, Bainbridge Island, WA (US); Justin Chase Bothell, Port Townsend, WA (US); G. Kyle Lobisser, Los Altos Hills, CA (US)

(73) Assignee: RIPELOCKER LLC, Bainbridge Island, WA (US)

( * ) Notice: Subject to any disclaimer, the term of this patent is extended or adjusted under 35 U.S.C. 154(b) by 32 days.

(21) Appl. No.: 15/294,554

(22) Filed: Oct. 14, 2016

Related U.S. Application Data

(60) Provisional application No. 62/242,840, filed on Oct. 16, 2015.

(51) Int. Cl.
*B65D 81/20* (2006.01)
*B65D 25/04* (2006.01)
(Continued)

(52) U.S. Cl.
CPC ..... *B65D 81/2015* (2013.01); *B65B 25/023* (2013.01); *B65B 25/041* (2013.01);
(Continued)

(58) Field of Classification Search
CPC ..... B65D 81/2015; B65D 1/22; B65D 19/02; B65D 21/0233; B65D 25/10; B65D 43/02;
(Continued)

(56) References Cited

U.S. PATENT DOCUMENTS 2,890,810 A * 6/1959 Rohling ..... B65B 31/00 206/508
3,085,913 A 4/1963 Caswell
(Continued)

OTHER PUBLICATIONS

Burg, S.P., "Postharvest Physiology Hypobaric Storage Fresh Produce," CABI Publishing, Oxfordshire, UK, ISBN 0851998011, © S.P. Burg 2004. [Relevant portions: Section 2.1, p. 9; § 6.20, p. 275; § 9.6, p. 358; § 9.10, pp. 365-366; §§ 12.1 and 12.2, pp. 484-485; § 5 12.8, p. 493; §§12.1-13.5 (examples of metal and concrete systems], pp. 495-521.].

*Primary Examiner* — Rafael A Ortiz
(74) *Attorney, Agent, or Firm* — ÆON Law; Adam L. K. Philipp; Martin Spencer Garthwaite

(57) ABSTRACT

A system and method for transporting and storing post-harvest fruits, vegetables and other perishable commodities under controlled atmospheric conditions is provided. One or more transportable vacuum containers are packed with the perishable commodity. Thereafter, the controlled atmospheric condition is created within the container. The atmospheric condition is maintained while the container is transported from one location to another. Part of the controlled atmospheric condition includes the formation of a vacuum within the container. Internal structure is provided within the container to resist collapse of the container when the vacuum is formed therein. A plurality of containers can be provided. A central control, coupled to each of the containers can be provided to maintain the desired atmospheric condition within each of the containers.

19 Claims, 12 Drawing Sheets

(51) Int. Cl.

| | |
|---|---|
| ***B65D 25/02*** | (2006.01) |
| ***B65B 31/00*** | (2006.01) |
| ***B65D 1/22*** | (2006.01) |
| ***B65D 43/02*** | (2006.01) |
| ***B65D 21/02*** | (2006.01) |
| ***B65D 85/34*** | (2006.01) |
| ***B65D 25/10*** | (2006.01) |
| ***B65D 85/50*** | (2006.01) |
| ***B65D 19/02*** | (2006.01) |
| ***B65B 25/04*** | (2006.01) |
| ***B65B 25/02*** | (2006.01) |

(52) U.S. Cl.
CPC ..... *B65B 25/046* (2013.01); *B65B 31/00* (2013.01); *B65D 1/22* (2013.01); *B65D 19/02* (2013.01); *B65D 21/0233* (2013.01); *B65D 25/10* (2013.01); *B65D 43/02* (2013.01); *B65D 81/2038* (2013.01); *B65D 85/34* (2013.01); *B65D 85/505* (2013.01); *B65D 2519/0082* (2013.01); *B65D 2519/0094* (2013.01)

(58) Field of Classification Search
CPC .. B65D 81/2038; B65D 85/34; B65D 85/505; B65D 81/203; B65D 81/2092; B65D 2519/0094; B65D 2519/0082; B65B 25/023; B65B 25/041; B65B 25/046; B65B 31/00; B65B 31/02
USPC ..... 206/386, 597, 497, 829
See application file for complete search history.

(56) References Cited

U.S. PATENT DOCUMENTS

| | | | | |
|---|---|---|---|---|
| 3,419,893 | A | 12/1968 | Collons | |
| 4,113,095 | A * | 9/1978 | Dietz | B65D 1/34 206/508 |
| 4,591,055 | A | 5/1986 | Corn | |
| 4,643,314 | A | 2/1987 | Kidd | |
| 5,028,443 | A * | 7/1991 | Wade | A23B 7/152 426/312 |
| 5,111,938 | A | 5/1992 | Soprano | |
| 5,261,976 | A | 9/1993 | Schultz | |
| 5,498,481 | A | 1/1996 | Marchek | |
| 6,536,192 | B2 | 3/2003 | King et al. | |
| 7,203,574 | B2 * | 4/2007 | Caci | H01M 8/0432 361/688 |
| 8,783,002 | B2 * | 7/2014 | Bowden | B65B 31/04 426/316 |
| 2009/0230012 | A1 | 9/2009 | Choy et al. | |
| 2010/0200599 | A1 * | 8/2010 | Molthen | B65D 19/06 220/592.27 |
| 2013/0156912 | A1 * | 6/2013 | Espinosa | A47F 3/001 426/418 |
| 2015/0108037 | A1 | 4/2015 | Evans et al. | |

* cited by examiner

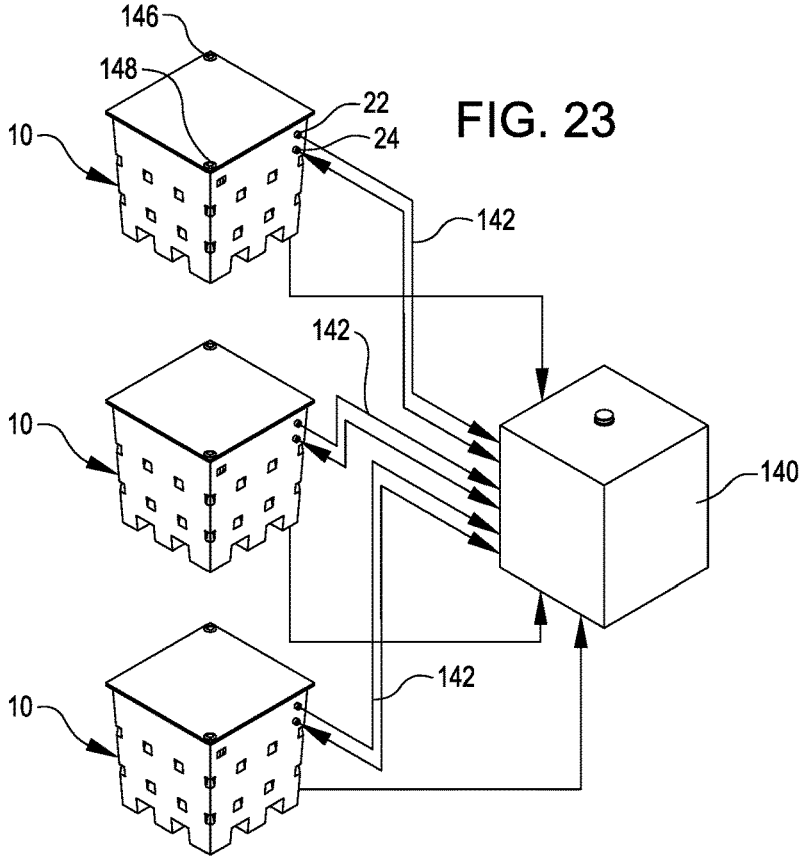
FIG. 23
FIG. 24
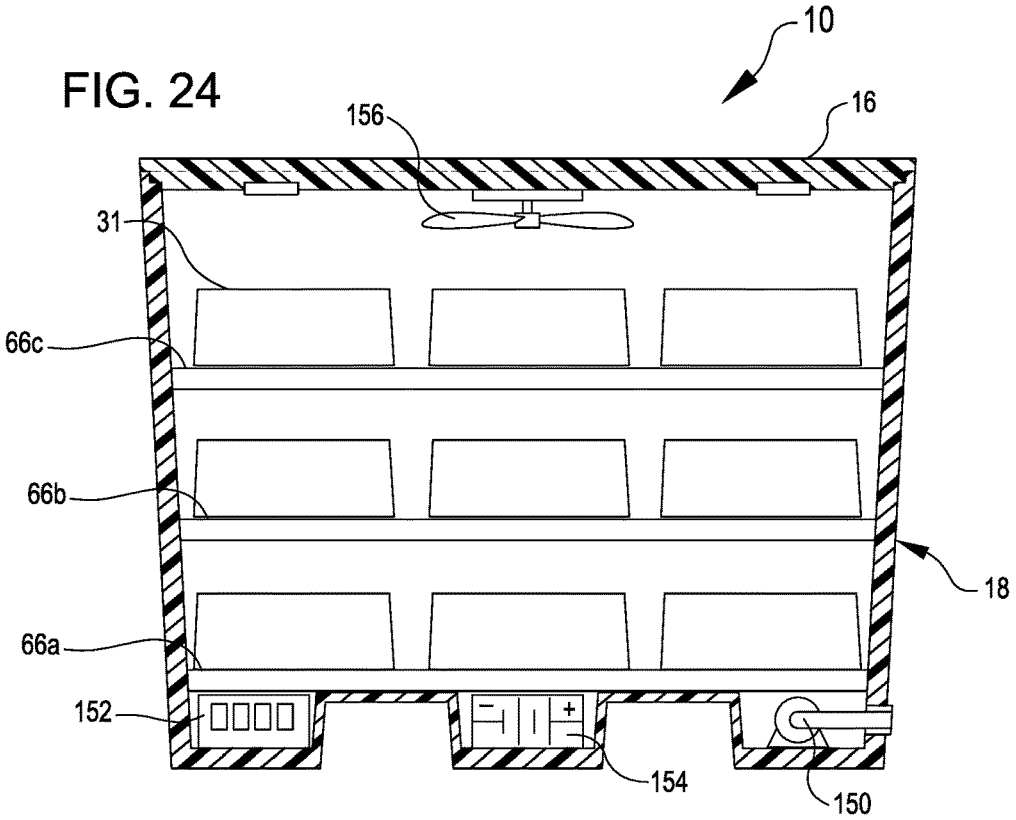

SYSTEM AND METHOD FOR TRANSPORTING AND STORING POST-HARVEST FRUITS, VEGETABLES AND OTHER PERISHABLE COMMODITIES UNDER CONTROLLED ATMOSPHERIC CONDITIONS

CROSS REFERENCE TO RELATED APPLICATIONS

This patent application claims the benefit of and priority to U.S. Provisional Patent Application Ser. No. 62/242,840 filed on Oct. 16, 2015, entitled "System and Method for Transporting And Storing Post-Harvest Fruit, Vegetables And Other Perishable Commodities Under Controlled Atmospheric Conditions" the disclosure of which is hereby incorporated by reference for all purposes.

FIELD OF THE INVENTION

The invention relates to systems, methods and apparatus for extending the post-harvest life of fruits, vegetables, and other perishable commodities, such as flowers, meat and fish.

BACKGROUND

A basic problem that has existed since the dawn of agriculture is that, while the human demand for fruits and vegetables often exists year round, the growing season does not. Many perishable commodities, such as fruits, vegetables, flowers, meat and fish can only be grown and/or ripened during specific, typically short, times of the year. Furthermore, such commodities are often grown far from the markets in which they are sold and consumed. The time spent in shipping such perishable commodities still further reduces the practical time during which the perishable commodities can be sold and consumed. In the case of certain fruits, such as strawberries, blueberries, etc., the time between when the fruit is ripe for harvest and when it begins to spoil is often short. This creates the dual problems of, for example, having too much fruit and vegetable being available during the peak of the harvesting season, and too little being available during the off, or non-peak seasons. Much effort has, accordingly, been directed toward extending the post-harvest life of fruits, vegetables, flowers, meat, fish and similar perishable commodities intended for human consumption and/or use.

One known technique for extending the post-harvest life of fruits and vegetables involves placing the perishables in a vacuum for storage. It has been determined by both Stanley P. Burg and the present inventors, that by placing harvested fruits, vegetables and other perishable commodities in vacuums from between approximately 10 to 150 Torr, often in combination with refrigeration, the degradation of the perishable commodities can be significantly slowed as compared to refrigeration alone.

Although the beneficial effects of vacuums on harvested fruit and vegetables are known, many problems exist in using such techniques in actual practice. Prior attempts have included building specialized refrigerated vacuum rooms, large ISO containers and/or large-scale containers for storing the perishable commodities after harvest and before shipment to retailers and consumers. Such rooms and containers are large, bulky, immovable and expensive. Although effective in reducing degradation during the time the fresh perishable commodities remain in the container, degradation at a faster rate resumes once the perishable commodities are removed for further shipment. Still further problems are encountered when the need to keep the perishable commodities hydrated under vacuum conditions is considered.

Accordingly, there is a heretofore unmet need in the art for practical, economical ways of reaping the benefits of vacuum storage for fruits, vegetables and other perishable commodities in the actual market for such goods.

SUMMARY OF THE INVENTION

The invention is directed to apparatus, methods and control techniques for placing and keeping harvested fruits, vegetables and other perishable commodities in a vacuum environment from shortly after they are harvested until shortly before they are offered for retail sale. More particularly, the invention is directed to methods and techniques for placing and keeping harvested fruits, vegetables and other perishable commodities in a vacuum environment through the use of reusable, inexpensive vacuum chambers that are compatible with, and usable within, the existing worldwide fruit and vegetable logistic chain (e.g., cold rooms, trucks, ships, distribution centers, etc.). Such methods, apparatus and techniques include the use of many relatively small, relatively inexpensive, preferably reusable containers that contain the fruit and vegetables and maintain them under a vacuum as they are transported from the growing site and ultimately to retail consumers. Preferably, the containers are shaped and dimensioned to be easily handled by standard fork trucks and shipped in standard shipping containers. Additionally, the containers are capable of withstanding and maintaining a vacuum during the time under which fruits are subject to vacuum storage. Preferably the containers are lightweight, easily handled and inexpensively manufactured. Preferably, the containers are reusable over many shipping cycles. Preferably, the containers are manufactured of a molded plastic or composite material that is capable of withstanding vacuum. Preferably, the containers are manufactured of a molded plastic or composite material that is compatible with use with food products intended for human consumption. Preferably, the containers are manufactured of a molded plastic or composite material in conjunction with one or more, removable or integral, internal bulkhead structures or stiffening members that help the container withstand a vacuum inside.

Preferably structures are provided for creating and maintaining a desired, controlled atmosphere within the container. To this end, the containers are provided with valved air inlet and outlet ports, coupled to one or more vacuum pumps, or one pump coupled to many systems, through which a vacuum can be created and maintained. In some embodiments, a gas permeable membrane can be incorporated to increase the relative concentration of certain gas components (e.g. Oxygen) in the container while under vacuum. The air inlet port can be controlled so as to allow the controlled introduction of gas, humidity, antimicrobial, anti-fungal agents, etc., into the container. Temperature, pressure, Oxygen, Carbon Dioxide and humidity sensors are preferably provided for monitoring atmospheric conditions, such as the relative levels of Oxygen ($O_2$) and Carbon Dioxide ($CO_2$) within the container, and a preferably computer-based control system is coupled to the various sensors, vacuum pumps, humidifiers, etc., to permit substantially real time monitoring and control of the atmosphere within the chamber. Atmospheres of various predetermined gas mixtures, constituents and ratios can be maintained within the containers to achieve the most effective preservation and life of the fruit, vegetables and other perishable commodities contained therein.

In some embodiments, the vacuum pumps, humidifiers control circuitry, etc. are contained within the container to provide a self-contained, stand alone device for maintaining fruits, vegetables and other perishable commodities under vacuum conditions. In other embodiments, two or more containers are coupled to one or more external vacuum pumps, humidifiers, gas sources, air separators, gas generators, control systems, etc., to enable the operation of multiple containers at a time. This is particularly effective if multiple containers are contained within a single shipping container and it is desired to minimize the number of needed pumps, humidifiers, refrigeration units, etc. In some embodiments, a battery and/or auxiliary power unit can be provided in addition to, or in lieu of a hard-line power supply to ensure maintenance of the desired conditions within the container in the event of a power failure.

In some embodiments, the computer-based control system can be remotely monitored and controlled to permit immediate intervention and adjustment should a malfunction or other anomaly take place during the shipping and/or storage operation. In one embodiment, the computer-based control system monitors and logs the various control parameters to provide an accessible record of conditions during the storage process to verify that the desired conditions were maintained over the desired storage period.

In some embodiments, the vacuum itself can help provide additional or primary cooling of the stored commodity by reducing pressure below the vapor pressure of water to flash the water and thereby achieve cooling.

These and other features and advantages will be apparent from a reading of the following detailed description and a review of the associated drawings. It is to be understood that both the foregoing general description and the following detailed description are explanatory only and are not restrictive. Among other things, the various embodiments described herein may be embodied as methods, devices, or a combination thereof. The disclosure herein is, therefore, not to be taken in a limiting sense.

BRIEF DESCRIPTION OF THE FIGURES

FIG. 23 is a schematic view of a system for maintaining and transporting perishable products under vacuum conditions using a plurality of transportable vacuum containers under the control of a master control unit.

FIG. 24 is a sectional view of still another embodiment of a transportable vacuum container wherein apparatus for maintaining the desired controlled atmospheric conditions is self-contained within the transportable vacuum container.

DETAILED DESCRIPTION

Figure 1:
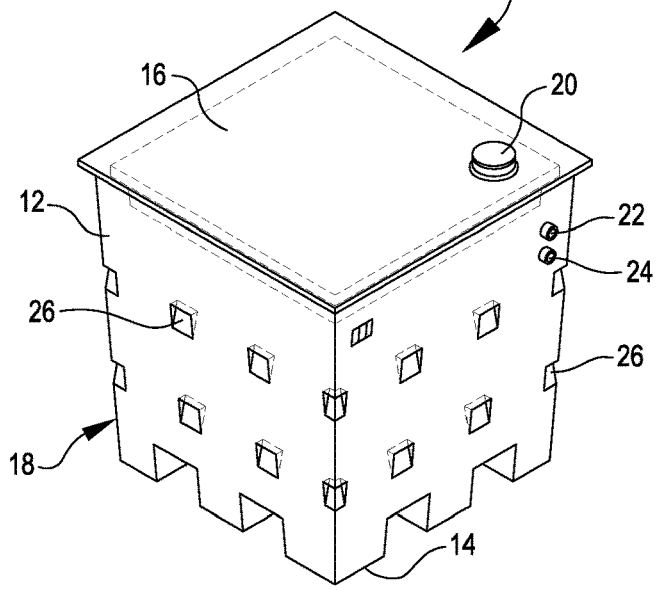
FIG. 1 is an isometric view of one embodiment of a transportable vacuum container constructed in accordance with various aspects of the invention.

Various embodiments will be described in detail with reference to the drawings, wherein like reference numerals represent like parts and assemblies throughout the several views. Many details of certain embodiments of the disclosure are set forth in the following description and accompanying figures so as to provide a thorough understanding of the embodiments. Reference to various embodiments does not limit the scope of the claims attached hereto. Additionally, any examples set forth in this specification are not intended to be limiting and merely set forth some of the many possible embodiments for the appended claims.

Disclosed herein are various systems, structures, methods and techniques for preserving and extending the post-harvest life of various perishable commodities, including but not limited to fruits, vegetables, meats, fish and flowers. Broadly speaking, these systems, structures, methods and techniques are intended to make use of low pressure, controlled environments to slow processes, such as ripening, dehydration and mold growth, that can degrade perishable commodities and render them unfit for sale, consumption or use. "Low pressure" as used herein generally includes pressures between about 5 and 180 Torr. "Controlled environment" or "controlled atmospheric conditions" as used herein refers to controlling such parameters as Oxygen and/or Carbon Dioxide concentrations, as well as humidity and temperature of the gas(es) surrounding the commodities while held at low pressure.

Size

The containers utilized in connection with the invention are preferably sized for use with pallets common to North America, Europe, Asia and Australia. Such pallets typically range from 31.5 to 45 inches wide, 42 to 55 inches long and 12 to 84 inches high. In Europe, both ½ and ⅛ size pallets are available. Accordingly, in this market containers sized approximately 15.75 inches wide by 11.81 inches long can also be provided to accommodate such pallets. Regardless of size, the containers are of substantially cubical or rectangular solid design to facilitate loading onto pallets and placement into standardized shipping containers.

Shape

As noted, the containers are preferably cubical or of rectangular solid form and shape. To facilitate the efficient transport of empty containers, the containers can be tapered to allow nesting. This helps reduce the amount of empty or wasted space occupied by the containers when empty and helps reduce shipping costs when new containers are transported to the field before initial use and when empty containers are returned to the field after completing a shipping cycle.

The containers can also include structure for permitting transport by means of forklift trucks or similar devices. To this end, feet may be provided on the bottom of the container to facilitate engagement with the forks of a forklift, or recesses can be provided for the same purpose.

Preferably, the containers include a main body that comprises the main space for containing the fruits, vegetables, and other perishable commodities, and further include a lid or cover portion that engages the main body to form a vacuum-tight container. In one embodiment, the lid forms the top of the container and is attached to the container after the commodities are loaded into the underlying main body. Alternatively, the lid can be at the bottom, and the main body placed over the lid after the commodities are loaded on top of the lid. In such a case, the lid can be provided with channels or other structure for engaging the forks of a forklift.

Preferably, the lid includes a recessed flange to help form a vacuum seal in cooperation with the main body. Preferably, the vacuum seal is formed, in part, by means of an O-ring or extruded material engaging the flange. Preferably, the O-ring or extruded material are easily replaceable to help maintain the vacuum integrity of the container over multiple uses. Alternatively, a replaceable gasket can be used to help form the vacuum seal. Preferably, the lid includes one or more handles, pockets or other structures to facilitate installation and removal of the lid.

Because water vapor can condense within the container, the container may be provided with recessed pockets in the floor to collect any such condensed water vapor.

Internal Bulkhead

Under conditions of vacuum, e.g., 1.3% atmosphere or 10 Torr, considerable pressure is placed on the walls of the containers. At such vacuums, such pressure is approximately one ton per square foot. To help resist such pressures, the containers can be provided with an internal support structure in the form of one or more bulkheads extending from wall to wall, and from top to bottom, within the container. In one embodiment, a single bulkhead can extend across the interior of the container to provide support for the external walls of the container. In another embodiment, multiple bulkheads can extend across both the length and width of the container to provide additional support. Additionally, the bulkhead(s) can be arranged to form shelf like structures in the container to provide support for the fruit or vegetables packed within. In this way, the bulkhead(s) act as stackable shelving capable of handling multiple package sizes. Preferably, the bulkhead(s) are removable from the container both to facilitate cleaning and to allow nesting of the containers during empty shipping or storing. Additionally, the bulkhead(s) can be collapsed for return shipping as well.

The bulkheads can be formed of a number of suitable materials such as metallic honeycomb structures, corrugated metallic or plastic structures or composite materials.

In addition or in lieu of the bulkheads, stringers can be incorporated to help stiffen and strengthen the containers. Such stringers can be integrally formed with the containers or added to the containers as separate structures. The stringers can be of simple square or rectangular cross section, or can be of "L" or "T" shaped cross section to improve stiffness while reducing weight. Other cross sections can be used as well.

Construction Materials

A variety of materials can be effectively used in constructing the vacuum containers. Such materials can include Polyethylene (PE), Polypropylene (PP), Polyethylene Terephthalate (PET), Nylon, Fiberglass, Carbon Fiber, Aluminum and Steel and similar structural materials capable of withstanding vacuum and the stresses associated therewith. The competing trade-offs in selecting appropriate materials include, strength, weight, cost, durability and compatibility with food products.

To facilitate handling and shipping, the containers preferably weigh less than 325 pounds, exclusive of the fruit, vegetables, and other perishable commodities packed within. Preferably, the containers are capable of withstanding up to fifty pressure cycles per year over an expected life of ten years. Similarly, the containers are preferably capable of withstanding external temperature variances of from approximately 140 degrees Fahrenheit to 0 degrees Fahrenheit. The material should be leak tight and able to withstand relative humidities up to 100%. The selected material should be approved for contact with food and should be chemically inert, exhibiting no adverse reactions with quarantine chemicals, oil and pollutants. The selected material should be capable of withstanding and handling severe contact and impacts, such as from forklifts and shock drops, and should be strong enough to allow for stacking full containers on top of one another.

The vacuum storage techniques of the present invention are preferably utilized in conjunction with refrigeration so that the stored fruits and vegetables are subject to both low temperatures and vacuum during storage. During storage, it is common for both fruits and vegetables, as well as flowers to give off heat during respiration. In addition, and as described below, it may be advantageous to include apparatus, such as vacuum pumps, humidifiers, monitoring systems, within the containers, which produce heat in their own right. To facilitate the cooling of the stored fruits, vegetables, and other perishable commodities, and to help dissipate any heat that may be generated within the container, the walls of the container are preferably thermally conductive. When bulkheads are used, they, too, can be so constructed. Alternatively, the bulkheads themselves can be formed of a thermally conductive material, such as for example, Aluminum or Steel, to help cool the commodity stored adjacent thereto. Fillers, such as thermally conductive metal flakes and/or carbon fiber, can be added to improve thermal conductivity when the container is made from a thermoplastic, composite, or other non-metallic material. Preferably, the walls of the container are substantially uniform in thickness and dimension so as to maintain temperature uniformity when a packed container is placed into a cold room for cooling. Advantageously, the inner walls of the container can be made shiny so as to limit thermal emissivity.

Certain known antimicrobial/anti-fungal additives can be added to the thermoplastics used to form the container to suppress the growth of pathogens on the plastic. One such known additive is an antimicrobial agent, believed to be Zinc Pyrion, available from Janssen PMP, a division of Janssen Pharmaceutica NV under the trademark SANAFOR.

Operation and Control

As previously noted, the containers can be loaded in either of two principal ways. First, the opening to the container can be placed at the top and the fruit, vegetables, and other perishable commodities placed into the chamber of the container through the opening at the top. Thereafter, the lid can be placed over the opening and sealed to the chamber. Alternatively, the lid or pallet can be loaded first and the chamber thereafter placed over it (i.e., the container or chamber acts as the "lid") and then sealed. To facilitate loading, in either instance, the lid portion of the container preferably extends across substantially the entire width and length of the container or chamber. In one embodiment, access to the chamber can be obtained by means of a removable side panel, thereby permitting loading through the side of the container.

Once the chamber is loaded and the lid put in place, the lid is tightly secured to the chamber by means of clamps, fasteners or otherwise to create a vacuum seal. Alternatively, the weight of the components, augmented by the pressure of the ambient air when the vacuum is created, can be used to effectuate the seal. The chamber or lid preferably includes embedded air inlet and outlet ports that are separately controllable. Preferably, the inlet and outlet ports are on opposite sides of the container. Alternatively, such structures can be placed in the lid or pallet when the chamber is used as a cover over the fruit, vegetables, and other perishable commodities loaded onto the pallet. Preferably, "quick connect" connectors are provided with both the air inlet and outlet ports to facilitate the fast and easy connection of external hoses. The outlet port is coupled to a vacuum pump or other vacuum source to purge the container of the air inside and create a vacuum within the container. The air inlet port is substantially closed during this time to prevent significant ingress of air into the container while the vacuum is being formed. If desired, inner recessed hooks or similar structure can be provided in the interior of the container to permit hanging meat within.

To create the vacuum within the container(s), an external primary vacuum pump can be employed. In this way, a single, preferably high volume pump can create a vacuum in either one or a plurality of containers. Alternatively, a dedicated vacuum pump or pumps, embedded within the pallet, or container, can be provided for each container, (i.e., one vacuum pump per container). The use of an air outlet port in each container permits multiple containers to be coupled to or daisy-chained to a single vacuum pump. This is particularly effective and attractive in places where multiple containers will be present in the same location, such as a cold storage room or within a shipping container containing many of the containers constructed according to the invention.

As an alternative to an external vacuum pump, a vacuum pump can also be provided within a container constructed according to the invention. In such an embodiment, the interior of the container is provided with a dedicated recessed space into which the vacuum pump and associated controls can be mounted. Such a container would further include spaces or channels for wiring and power sources. In addition to the vacuum pump, the associated controls can include such devices as microprocessor based circuitry for monitoring the environment within the container and directing appropriate action to maintain a desired environment. Such circuitry can be monitored and controlled through Ethernet, WIFI, Bluetooth, cellular or other wired or wireless connections. The associated controls can also include various sensors for sensing the environmental parameters within the chamber (e.g., pressure, temperature, relative humidity, etc.) humidifiers for controlling the environment within the container, gas sources for adjusting the gas constituents of vacuum atmosphere that exists within the container, batteries for maintaining the desired environment in the event of a power failure or other loss of external electrical power, and power and other connectors for providing electrical power to the container and for obtaining data from sensors located within the container.

Operational Control

One important aspect of the invention in its broader respects is the flexibility provided to meet the needs of particular growers, shippers, commodities, markets and consumers. The use of relatively small, easily handled, individual containers in combination with various control, sensing and operational apparatus allows the environment within the containers to be precisely controlled and optimized to the particular circumstances surrounding the storage and/or shipping mission.

In one aspect, a humidity monitor may be placed within the chamber of the container to monitor the relative humidity within. An internal or external computer-based control coupled to the monitor senses the humidity and compares it to desired limits. If desired, a log can be maintained to provide a record of the humidity at various times during the storage period. In one embodiment, humidity can be provided to the interior of the chamber through the air inlet port of the container.

Similarly, the atmosphere within the chamber can be monitored and controlled. A pressure sensor is utilized to monitor pressure within the container and the control system coupled thereto operates to actuate the vacuum pump, or control the speed of the pump, as needed to maintain the vacuum within desired limits. If desired, the temperature of the atmosphere within the container can be monitored to permit corrective action if needed. Alternatively or additionally, temperature probes within the fruit, vegetables and other perishable commodities within the container can directly sense the temperature of the commodities to monitor whether their temperatures remain within desired limits.

In the event it is desired to modify the elemental constituents making up the atmosphere within the container, gas sensors within the chamber and coupled to the control circuitry can permit the introduction of desired gases (e.g., Oxygen) through the air inlet port and into the interior of the container to maintain the desired makeup of the atmosphere within. To this end, one or more gas sources can be provided, either within the container or externally thereto, to provide a source of the gases needed to provide the desired atmosphere. Alternatively, other techniques, such as the use of gas separators, filters and/or gas generators can be used to obtain the desired gas constituent directly from ambient air or other source. Similarly, the air exchange rate within the container can be continuously or periodically monitored and controlled. By simultaneously or independently adjusting the vacuum pump outflow rate, and controlling the inflow rate of air through the air inlet, a controlled and desired exchange of the atmosphere within the chamber can be achieved while maintaining a vacuum within the container. This is particularly useful while the fruit, vegetables and/or flowers within the container are undergoing respiration and giving off potentially deleterious gases. Alternatively, the air inflow rate can be varied while the outflow rate remains fixed.

As noted, an important aspect is the ability to control the atmosphere within the chamber while the fruits, vegetables, and other perishable commodities are stored under vacuum conditions. While a variety of gas monitors and gas constituents can be used, particularly beneficial results can be achieved by controlling, in particular, the Oxygen content of the atmosphere as well as the Carbon Dioxide component of the atmosphere. Various atmospheres containing predetermined ratios of gases have been developed and proposed for storing fruits and vegetables under standard atmospheric pressures. It is believed that use of such atmospheres under the vacuum conditions of the present invention can result in even further benefits as compared to the present use of such atmospheres under standard pressures. Alternatively, unique and new mixtures of gases can potentially be developed for particular use with the vacuum conditions obtained through use of the inventive containers, controls, methods and techniques disclosed herein. Carbon Dioxide scrubbers can be utilized to alter the Carbon Dioxide level and/or pressure within the container.

In addition or as an alternative to controlling the gaseous makeup of the atmosphere within the containers, various agents can also be introduced to further extend the life of the fruits and vegetables and/or enhance their appearance and desirability. In one embodiment, a fungicide is continuously or intermittently added to the interior of the container as a fog or vapor in low doses as gas is withdrawn from the container via the vacuum pump and replacement gas is drawn in through the inlet port. Alternatively, such a fungicide can introduced before the vacuum is formed. Again, this can be controlled real time via the computer control coupled to the container. Alternatively, the additive can be introduced into the interior of the containers via a primary pump in a one-time application minutes or hours before the vacuum is created. This can be done, if desired, at a receiving or distribution center in order to get the fungicide onto the fruit or vegetables. Because the vacuum itself has been found to suppress fungal growth, it is believed that lower doses of fungicide will be effective under vacuum conditions than what are needed under standard atmospheric conditions. Use of known fungicides, oils or other additives in combination with the vacuum techniques disclosed herein should permit either the use of lower doses than have heretofore been used, or may make alternative fungicides, such as those perceived to be more environmentally friendly or "greener" effective in a meaningful sense.

Methods of Use

The various aspects of the invention disclosed herein can be effectively used in many ways.

The containers disclosed and described herein can be easily and economically formed from relatively inexpensive and lightweight materials using a variety of molding techniques, including but not limited to centrifugal molding, injection molding and thermoforming. The containers (i.e., the chamber portion, the lid and any internal bulkheads) can be separately produced and shipped in nested, stacked or disassembled form from the manufacturer to the user so as to minimize shipping expenses. The use of relatively small, easily handled containers permits the fruits, vegetables, and other perishable commodities to be packed within the containers in or near the field. If refrigeration is desired or needed, the commodities can be initially cooled using a cold room, water immersion or other known techniques and thereafter packed into the containers. Alternatively, the fruit and vegetables can be packed into the containers and cooled once inside. To this end, cold air can be drawn through the containers at more-or-less standard atmospheric pressure until the desired temperature is reached, whereupon the vacuum is created after cooling is achieved.

Once packed, the relatively small containers can be assembled for storage or shipping to other locations or both. The process of creating the vacuum within the containers can also have a cooling effect on the commodities contained therein. The size and shape of the containers permits them to be easily handled and transported by standard forklifts, and their dimensions permit multiple containers to be effectively and efficiently packed into standard shipping containers.

The provision of air inlet and outlet ports, as well as power and data connection ports, on the containers allows multiple containers to be coupled together and placed under the control of a single, preferably computer-based, control system. The control system can substantially simultaneously monitor a plurality of containers and take individual action so as to maintain desired conditions within individual ones of the containers. If desired, wireless or other remote connections to the control systems can be maintained to permit substantially real time remote monitoring of the conditions within the containers. This permits, among other things, prompt corrective action should a system failure or other anomaly be detected. To ensure quality and provide verification that desired conditions were maintained during the shipping and/or storage period, a record or log of sensed conditions can be maintained by the control system and a verified report provided to the shipper or customer to verify that the specified conditions were, in fact, maintained.

After the shipping and/or storage operation is completed, the containers can be individually or collectively be delivered to a customers site for unpacking and ultimate delivery to retail customers. Depending on the particular market and the particular commodity, the containers can be cleaned and repacked with a different commodity for a return trip to the original departure point or other point. Alternatively, and in the case where no return commodity is available for shipping to the original departure point or elsewhere, the empty containers, and associated bulkheads, if any, can be sent back to the original departure point or other point from which it is desired to ship and/or store fruits or vegetables under vacuum conditions. To help facilitate such shipping and reduce the costs associated therewith, the nesting feature provided by some of the embodiments of the containers is particularly effective. The containers can be kept at a distribution center or on-site or can be kept at a store.

Industrial Applicability

The present invention finds particular applicability in the post-harvest fruit industry. The invention is particularly well-suited for use in connection with fruits, such as cherries, blueberries, strawberries, raspberries, blackberries, mangoes and similar fruits that are somewhat fragile in structure and susceptible to mold, rapid degradation, visual deterioration or other conditions that limit the effective life of the fruit as a viable commodity in the market.

The invention is also particularly well-suited for use in connection with fruits, such as strawberries and cherries, that are grown in a relatively short season, resulting in a relative glut of the goods during the harvesting season and a shortage at other times. By extending the useful life of the fruit, more of the fruit will be available for retail sale and consumption than would be the case if normal spoilage and degradation result in significant quantities being discarded or otherwise wasted.

EXAMPLES

Various examples of transportable vacuum containers embodying various aspects of the novel concepts disclosed herein will now be described with reference to FIGS. 1-23.

FIG. 1 illustrates one form of transportable vacuum container 10 that can effectively be used to maintain perishable products in low-vacuum, atmospherically controlled conditions during transport. As illustrated, the container 10 comprises a generally cube or other generally rectangular-solid shaped structure having four side walls 12, a bottom wall, panel or base 14, and a top wall or panel 16. In the illustrated embodiment, the four side walls 12 and bottom wall or panel 14 comprise a unitary container structure or chamber 18, while the top wall 16 comprises a separate structure in the form of a removable lid. The container or chamber portion 18 forms a generally hollow interior for containing the perishable products. After the perishable products are loaded into the container portion 18, the lid 16 can be fastened over the top of the container portion to form a six-sided transportable container 10 fully enclosing the perishable products contained therein. The chamber portion 18 is substantially air-tight, while a gas seal is formed where the lid 16 meets the chamber portion 18 to form a substantially air-tight container 10 capable of maintaining and holding a vacuum therein.

Figure 2:
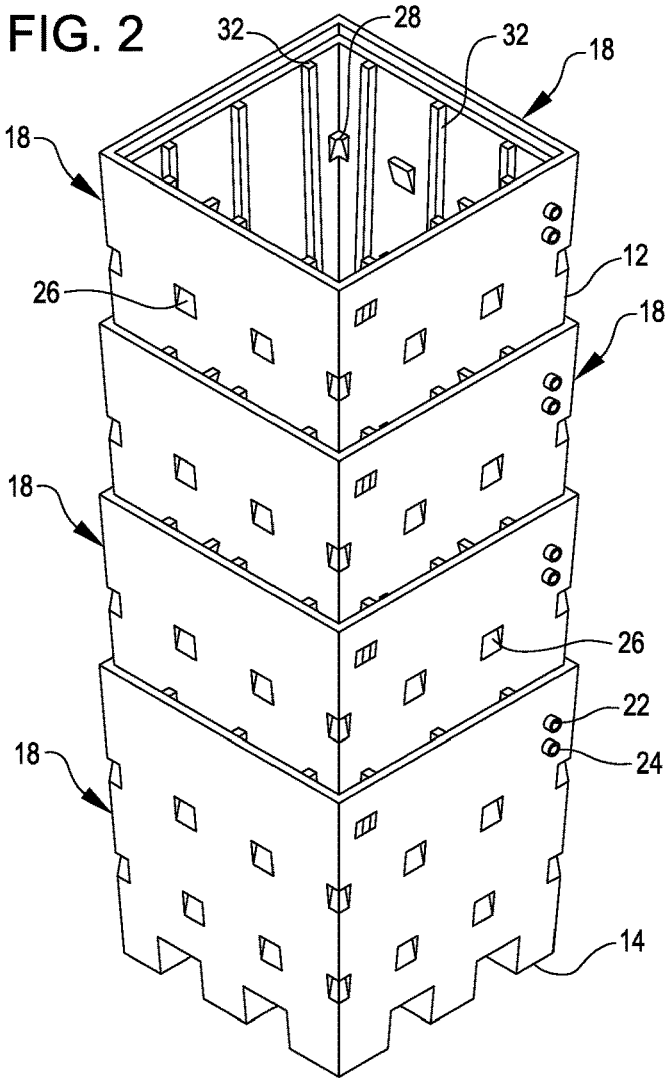
FIG. 2 is an isometric view of a plurality of transportable vacuum containers of the type shown in FIG. 1, illustrating the nesting feature of the containers.

As further illustrated in FIG. 1, the side walls 12 of the chamber portion 18 are not precisely orthogonal, but, rather, preferably taper inwardly, slightly, from top to bottom so that the chamber portion is larger or wider at the top than at the bottom. By so tapering the side walls 12 of the chamber portion 18, the chamber portions 18, when empty, can be nested or stacked, as illustrated in FIG. 2. This permits multiple empty containers to be stored or transported taking up much less space or room than would be the case if the chamber portions were not so shaped and so capable of being nested or stacked.

In one embodiment, an aperture 20 can be provided, for example in the top lid 16, that can be coupled to a gas-permeable membrane or filter that preferentially allows the passage of smaller molecules, such as Oxygen, while preferentially blocking larger molecules, such as Nitrogen or Carbon Dioxide. This permits control over the atmosphere contained within the container 10 after the vacuum is formed so that the relative Oxygen concentration within the container 10 can be maintained at a somewhat higher or otherwise different level than would be the case if standard air concentrations were maintained. This has the benefit of reducing pumping "on" time, thereby reducing energy requirements.

As further illustrated in FIG. 1 an aperture 22 or fitting is preferably formed in one or more side walls of the container to permit the coupling of a vacuum pump or line to the container to form a vacuum within the container. As also illustrated in FIG. 1, an additional aperture or fitting 24 can be formed in the sidewall to permit communication with one or more sensors for monitoring parameters, such as temperature, humidity, gas concentrations, etc., within the container 10 after the vacuum is formed. Alternatively, the sensors, vacuum pumps and power supplies for operating them can be contained in either the lid 16 or the chamber portion 18 of each container 10 to reduce the complexity and cost of the container and to facilitate easy repair or replacement or recycling of the container during or following use.

As a vacuum is formed within the container, substantial inwardly directed pressure will be exerted on the sidewalls 12, the bottom 14 and on the top panel or lid 16 of the container 10. To resist such pressure and to prevent the inward collapse of the container 10 under conditions of high vacuum, various structures are preferably included to stiffen the container or otherwise resist such collapse.

Figure 3:
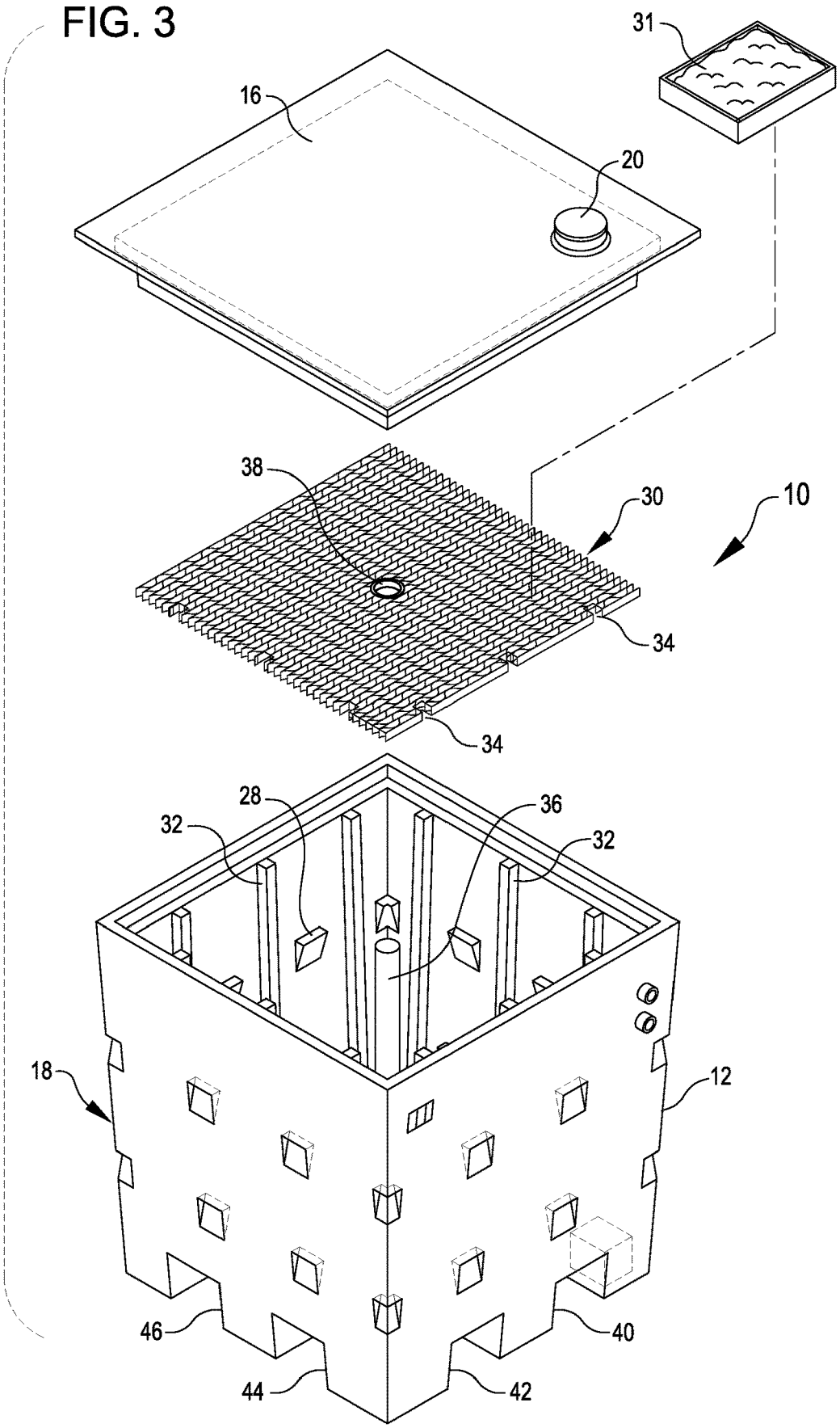
FIG. 3 is an exploded isometric view of the vacuum container illustrated in FIG. 1 showing various internal features of the container. end view of an embodiment of an inspection sled illustrating opened swing arms with a portion of the cable inserted within each collar.

With reference to FIGS. 1, 2 and 3, a plurality of inwardly directed recesses or pockets 26 are preferably formed along the sidewalls 12 of the chamber portion 18 at substantially constant levels above the base 14. These form a plurality of shelf-supports 28 in the interior of the container 10 at spaced levels above the bottom 14 of the container. In accordance with one aspect of the invention, one or more interior shelfs or bulkheads 30 can be installed into the container 10 that rest upon the shelf supports 28 so formed. The bulkheads 30 are preferably formed of a stiff, light-weight material capable of both supporting the weight of the perishable product 31 loaded into the container 10 as well as resisting the inwardly directed compressive forces transferred to the shelf or bulkhead 30 as the vacuum is formed and the sidewalls 12 of the container 10 flex inwardly under the pressure of the ambient air. Preferably, the shelves or bulkheads 30 are formed of a honeycombed aluminum corrugated panel that is both lightweight and stiff and that can be readily cut or shaped to fit closely within the container 10. It will be appreciated that other materials, such as corrugated plastic, fiberglass, etc., can also be effectively used.

To further stiffen the sidewalls of the container 10, a plurality of vertical stringers 32 are preferably formed on the interior walls of the side panels 12 as best seen in FIGS. 2 and 3. In the illustrated embodiment, the stringers 32 are of substantially square or rectangular cross-section and are integrally molded into the sidewalls 12. It will be appreciated that other cross-sectional shapes can be effectively utilized, such as "L" shaped, or "T" shaped stringers. To permit a close fit between the shelves or bulkheads 30 and the interior sidewalls of the container 10, appropriately located and shaped notches 34 are formed in the outer periphery of each shelf 30.

To resist inward collapse of the top lid 16 and bottom panel 14 of the container 10, a center support 36 is preferably included extending substantially vertically from substantially the center of the bottom panel 14 to substantially the center of the top panel or lid 16. In the illustrated embodiment, the center support 36 is preferably a hollow cylindrical tube formed of a stiff plastic, although it will be appreciated that other shapes and configurations (e.g. a solid rod) can effectively be used. As illustrated, each of the shelves or bulkheads 30 includes an aperture 38 to permit passage of the central support 36 there-through.

To facilitate transport of the vacuum containers 10 after they are loaded with the perishable products, parallel channels 40, 42 are preferably formed in the underside of the bottom panel 14 to accommodate forklift forks. In the illustrated embodiment, orthogonal pairs of parallel channels 40 42, and 44 46, are formed so that the forklift can approach and lift the container 10 from any side.

Figure 4:
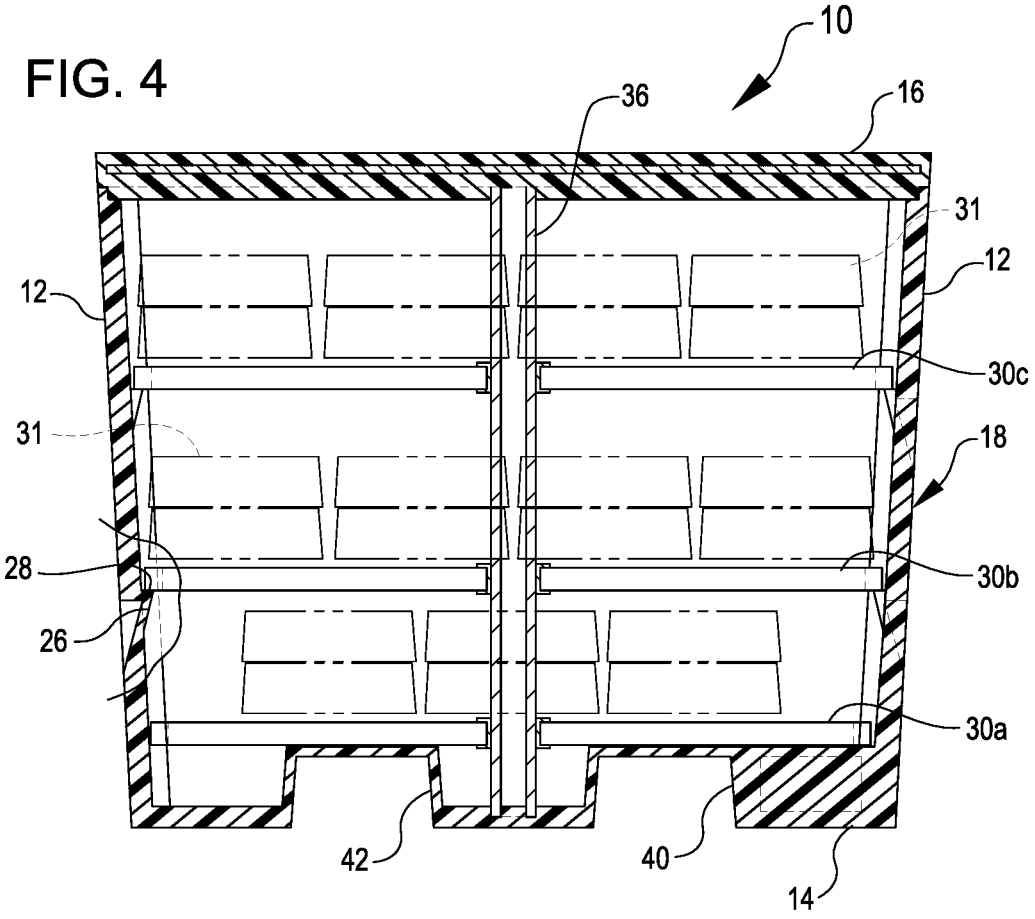
FIG. 4 is a sectional view of one embodiment of a transportable vacuum container of the type shown in FIG. 1 showing an arrangement of perishable products contained therein.

FIG. 4 is a sectional view of a transportable vacuum container 10 after it is packed with the perishable product 31, showing the internal arrangement of the internal supporting structures and the product. As illustrated, three generally horizontal, parallel shelves 30*a*, 30*b* and 30*c* are installed. The lowermost shelf 30*a* rests on the upper interior surfaces of the forklift channels 40, 42. The intermediate shelf 30*b* and the upper shelf 30*c* each rest on the ledges or shelves 28 defined by the inwardly directed recesses 26 formed in the outer walls 12 of the container 10. The central support 36 rests, at its lower end, on the interior surface of the lower panel 14, and the upper end contacts and supports the interior surface of the upper panel or lid 16. The central support 36 extends through the central aperture 38 formed at the center of each shelf. Boxes containing the perishable product 31 are supported by each shelf as illustrated. In use, the lowermost shelf 30*a* is first installed and the perishable products 31 are placed onto the shelf. Once the shelf 30*a* is filled, the next or intermediate shelf 30*b* is installed and more boxes 31 containing the product are placed onto it. The central support 36 can be installed at any point in the process as convenient, noting that the product should not be placed over the apertures 38 of the shelves 30. Once the intermediate shelf 30*b* is filled, the upper shelf 30*c* can be installed and filled with product. Once the upper shelf is filled, the top panel or lid 16 can be installed. A forklift can then be used to transport the filled container 10 to where needed.

Figure 5:
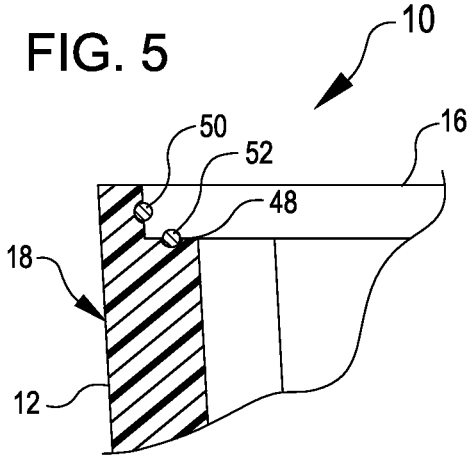
FIG. 5 is a partial sectional view showing one arrangement for sealing the lid of the transportable vacuum container to the container body.

FIG. 5 is a partial sectional view showing one arrangement for forming a vacuum-tight seal between the top panel or lid 16 and the lower container portion 18 of the container 10. As illustrated, the upper edge of the lower container portion include an interior rabbet or ledge 48 onto which the edge of the lid 16 rests. Preferably, the parts are dimensioned so that the lid 16 closely fits within and onto the ledge 48 thus formed. Preferably, one or more elastomeric sealing elements or gaskets 50, 52 are positioned between the lid 16 and the container portion 18 to effectuate an air-tight seal. In the illustrated embodiment, one seal 50 is placed in the vertical wall of the rabbet, and another 52 is place in the horizontal wall to form a double-sealed junction between the lid 16 and the lower container 18. The lid 16 can be secured in place by any number of fastening means, such as screws, bolts, latches, straps, etc.

Figure 6:
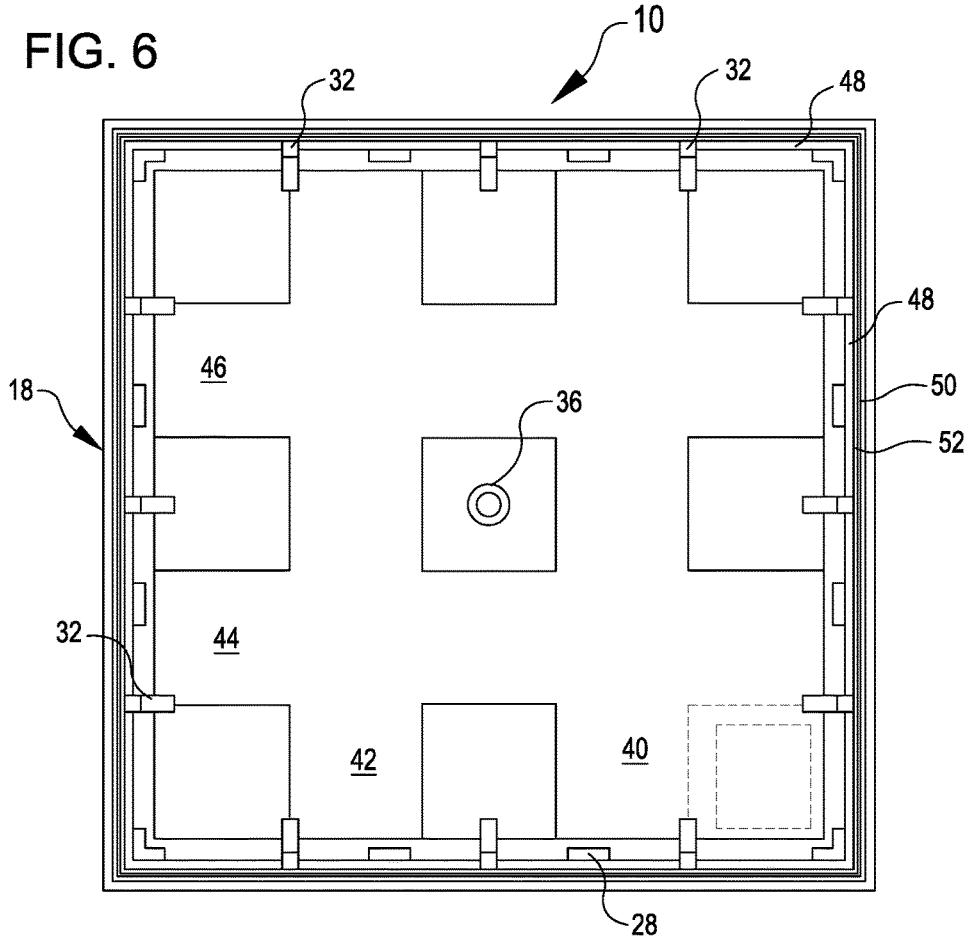
FIG. 6 is a top view of a transportable vacuum container.

FIG. 6 is a top plan view of the transportable vacuum container 10 shown in FIGS. 1-5 illustrating the relative positioning and arrangement of the orthogonal forklift channels 40, 42, 44, 46, the interior vertical stringers 32, the internal ledges 28 for supporting the interior shelves or bulkheads, the ledge 48 for supporting the lid, the seals 50, 52 for effectuating a vacuum seal and the center support 36 for supporting the lower panel and upper lid.

Figure 7:
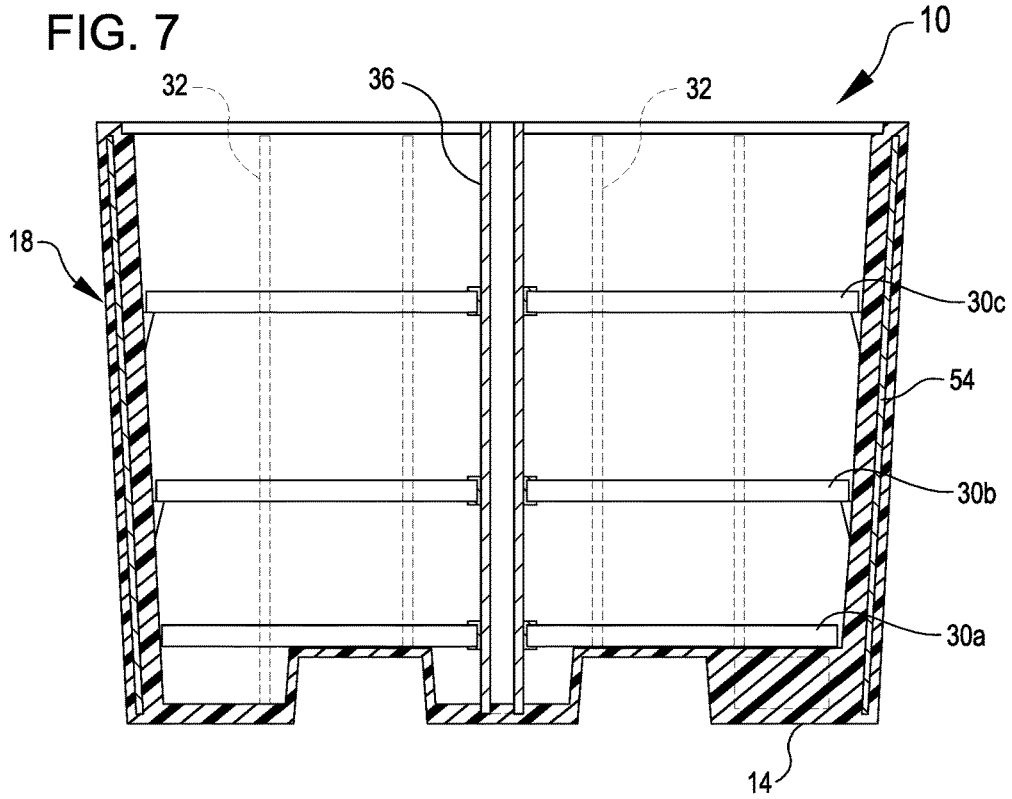
FIG. 7 is a sectional view of the transportable vacuum container shown in FIG. 6.

FIG. 7 is cross-sectional view, similar to FIG. 4. showing an alternative embodiment form of transportable, vacuum container 10. In this embodiment, the side walls 12 of the lower container portions 18 include a core 54 of differing material that can be selected to provide desired characteristics. For example, the core 54 can consist of a rigid, stiff material to help stiffen the walls 12 of the chamber 18 to further resist deformation under external pressure as a vacuum is created within the container 10. Alternatively, the core 54 can consist of an insulating material to help maintain desired thermal conditions within the container during transport and/or storage of the perishable products.

Figure 8:
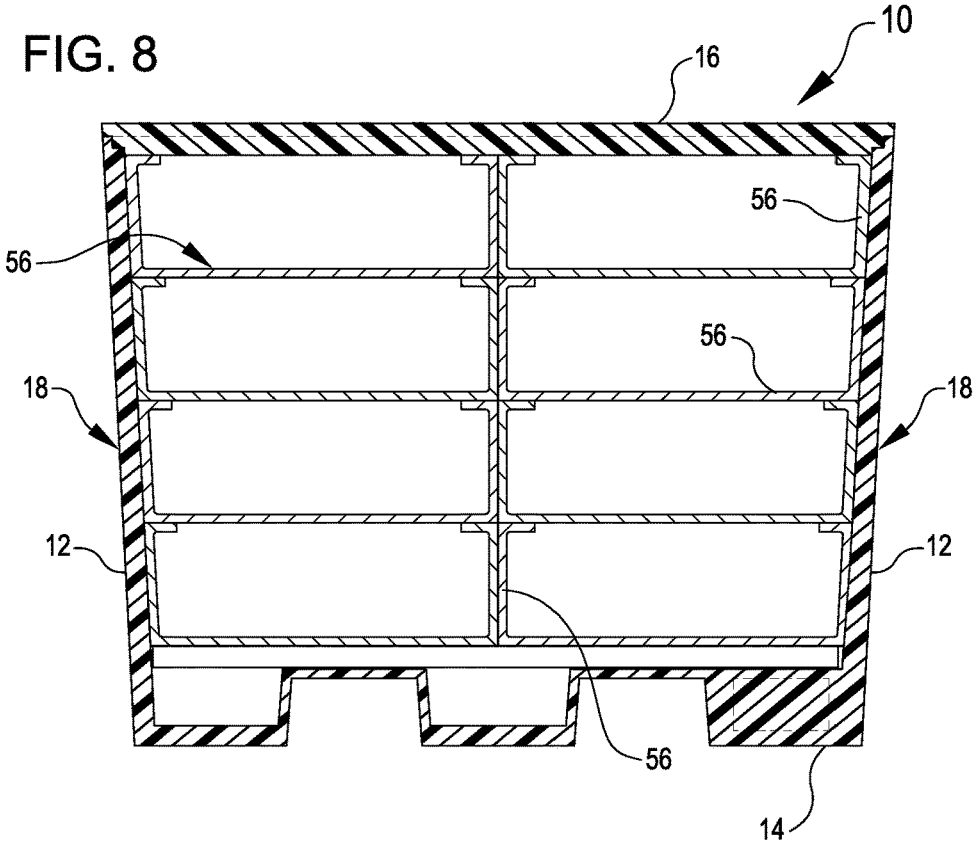
FIG. 8. is a sectional view of an alternative embodiment transportable vacuum container showing and alternative form of internal structure for resisting inward pressure.

FIG. 8 illustrates still another alternative embodiment of a transportable, vacuum container 10. In this embodiment, interior support for resisting the external pressure experienced by the container when a vacuum is created therein is provided by means of a plurality of reusable plastic containers 56. The reusable plastic containers 56 are shaped and dimensioned to stack one on top of another so as to substantially fill the interior of the lower container or chamber portion 18 of the vacuum container 10 and to substantially engage the side walls 12 of the container 10 as well as the lower panel 14 thereof and the underside of the top panel or lid 16. The reusable plastic containers 56 themselves are formed of a rigid plastic capable of withstanding the compressive forces transferred to them by the side walls 12, top panel 16 and lower panel 14 of the vacuum container 10.

As illustrated, the reusable plastic containers 56 are substantially rectangularly shaped and include an open upper surface to facilitate the loading of the perishable product within. In use, the reusable plastic containers 56 are filled with the perishable product. Once filled each reusable plastic container 56 is then placed into the lower or chamber compartment 18 of the vacuum container 10. This process is repeated until the compartment 18 is filled. The lid 16 is then secured over the compartment. As seen in FIG. 8, the reusable plastic containers 56 when placed into the compartment 18 form a rigid interior structure that helps resist the pressure exerted on the vacuum container 10 when the vacuum is created therein.

Figure 9:
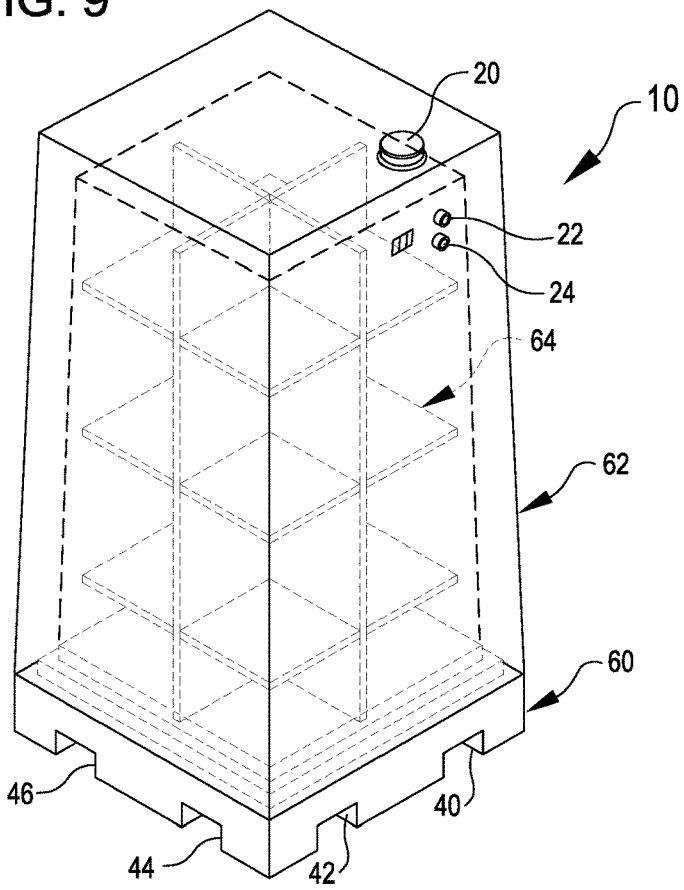
FIG. 9 is a perspective view of an alternative embodiment transportable vacuum container.
Figure 10:
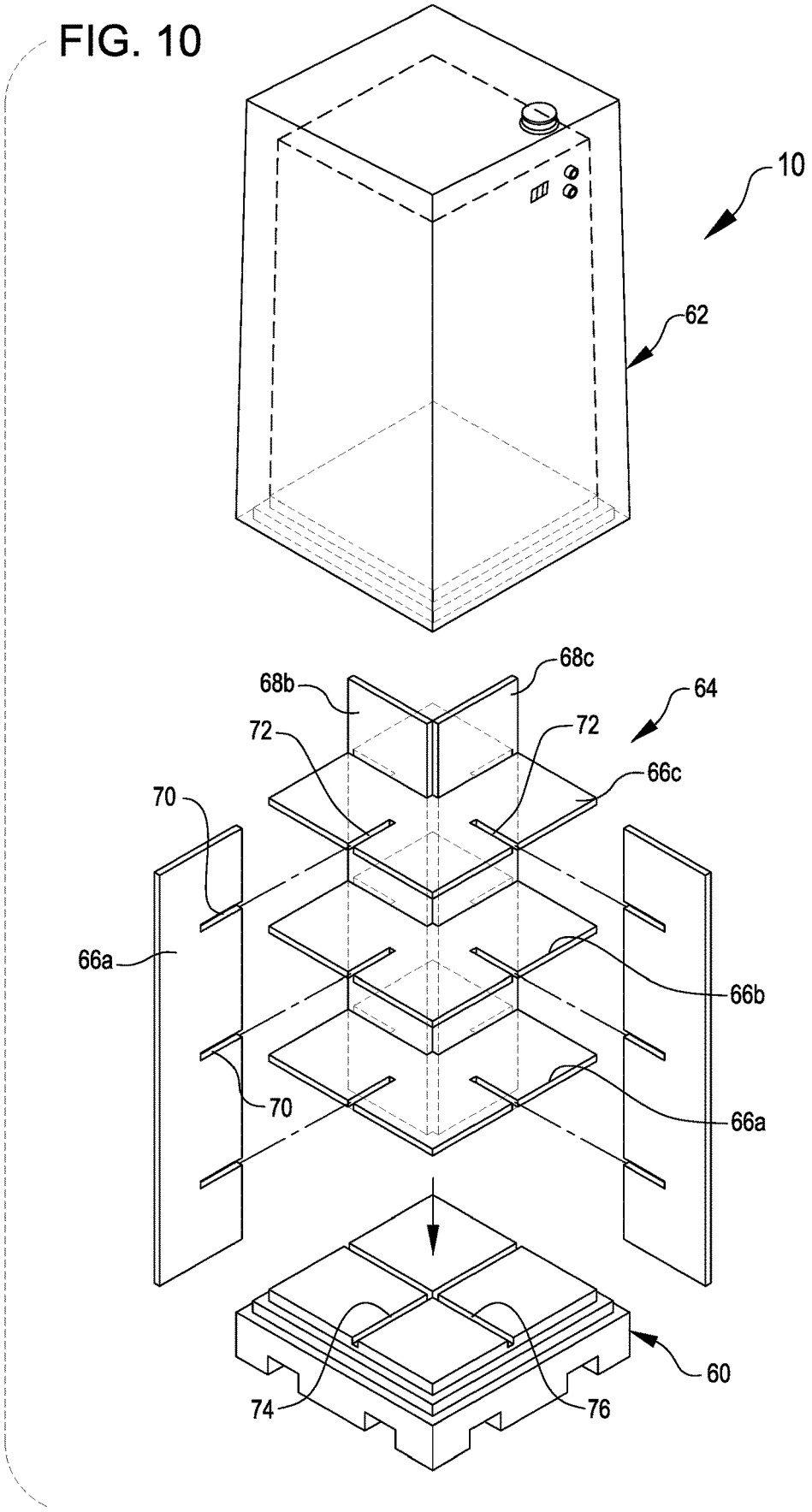
FIG. 10 is an exploded perspective view of the container shown in FIG. 9.

FIGS. 9 and 10 show still another alternative embodiment of a transportable vacuum container 10. In this embodiment the transportable vacuum container includes a bottom panel or pallet 60 onto which the perishable products are placed, after which an overlying cover 62 is installed so as to create a fully enclosed, vacuum-tight chamber. As in the earlier described embodiments, the bottom panel 60 is substantially rectangular or square in shape and includes channels 40, 42, 44, 46 for facilitating transport by means of a forklift. The cover 62 can be provided with an aperture 20 for coupling to a gas permeable membrane for controlling the gas constituents of any remaining atmosphere within the chamber and can be provided with ports 22, 24 for coupling to a vacuum pump or line as well as to monitoring apparatus as previously described.

The transportable vacuum container 10 shown in FIGS. 9 and 10 further includes an interior structure or bulkhead assembly 64 for resisting the compressive forces experienced by the container 10 when under vacuum. In the illustrated embodiment, the interior structure 64 includes a plurality of intersecting horizontal and vertical panels 66, 68 that are preferably formed of a honeycomb aluminum panel or corrugated plastic or similar material as previously described.

In the illustrated embodiment, the internal structure or bulkhead 64 includes four substantially rectangular vertical panels 68*a*, 68*b*, 68*c*, 68*d* and three substantially square or rectangular horizontal panels 66*a*, 66*b*, 66*c* that can be assembled as shown to form three horizontal shelves above the lower panel or base 60. As illustrated, a plurality of slots 70, 72 are formed in the vertical and horizontal panels 68, 66 to facilitate assembly of the internal structure or bulkhead 64, and a pair of orthogonal slots 74, 76 can be formed in the upper surface of the base or lower panel 60 to further facilitate assembly of the structure.

Once the internal bulkhead structure 64 has been assembled, the perishable products can be placed onto the bottom panel 60 and the overlying shelves 66*a*, 66*b*, 66*c*. Because the internal support for the container 10 is provided by the internal structure or bulkhead 64, the perishable products can be contained in non-rigid structures, such as cardboard boxes or pallets, or bags. Once the perishable products are put in place on the shelves, the overlying cover 62 can be installed to fully enclose the products. Thereafter, the vacuum can be formed in the container 10 and the container moved for transport or storage. Seal structures, to be described below in more detail with reference to FIGS. 14-20, are provided between the overlying cover 62 and the bottom or base panel 60 to effectuate an air-tight sea.

Figure 11:
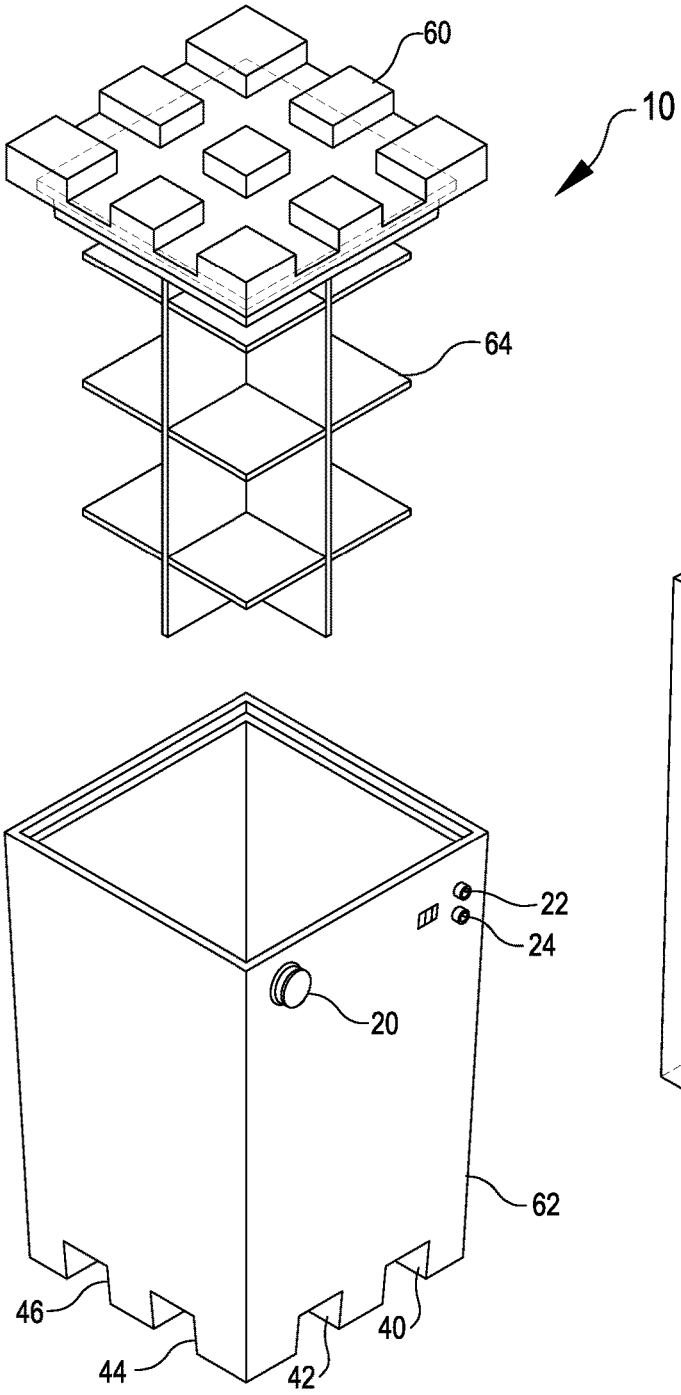
FIG. 11 is an exploded perspective view of another alternative embodiment transportable vacuum container.

FIG. 11 illustrates another alternative embodiment, similar to that shown in FIGS. 9 and 10, wherein the overlying cover 62 and the base 60 are essentially inverted so that the perishable product is loaded from the top into the chamber portion and the base 60 thereafter put into place. In this embodiment, the internal support or bulkhead structure 64 is suspended from the underside of the base 60, and the base, with suspended structure and perishable product loaded thereon, is thereafter lowered into the chamber 62. The base 60 is then sealed to the chamber 62, and the container then placed under vacuum for transport. As illustrated, channels for receiving a forklift can be formed in the underside of the chamber 62 to facilitate transport after the container has been packed and sealed.

Figure 12:
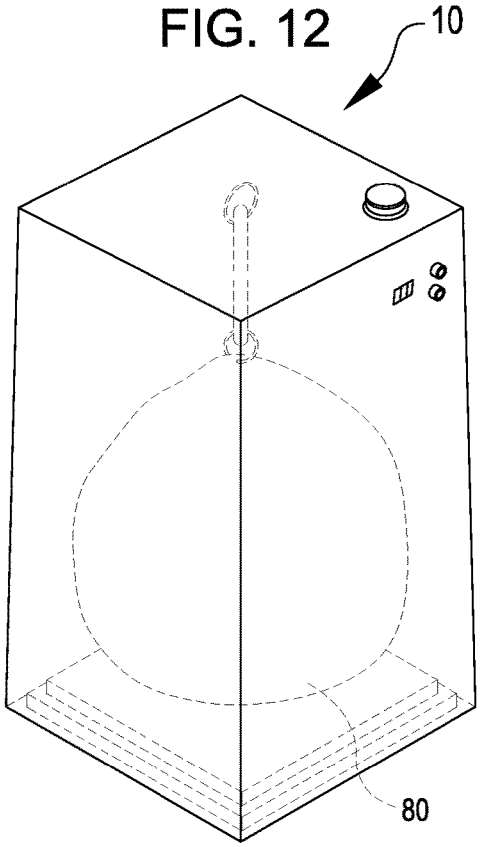
FIG. 12 is a perspective view of still another alternative embodiment transportable vacuum container.

FIG. 12 illustrates another alternative embodiment, similar to that shown in FIGS. 9 and 10, that is particularly well suited for the transport and storage of perishable products that, unlike relatively fragile fruits, such as cherries and berries, do not need particular protection against crushing. Such products can include, for example meat products or other self-supporting, relatively durable, goods. In this embodiment, the perishable product can be contained within a bag 80, formed, for example, from plastic, that is thereafter suspended from the interior of the overlying cover 62. To resist external pressure of the ambient air when the container is placed under vacuum, an interior structure, similar to those shown and described, is used. However, to accommodate the bag 80, the interior structure is shaped and dimensioned to leave a sufficiently large open space to receive the bag 80. This can be achieved, for example, using the stringers 32 previously described, as well as by interior bulkheads that are substantially rectangularly annular, thereby leaving an open interior for receiving the bag 80.

Figure 13:
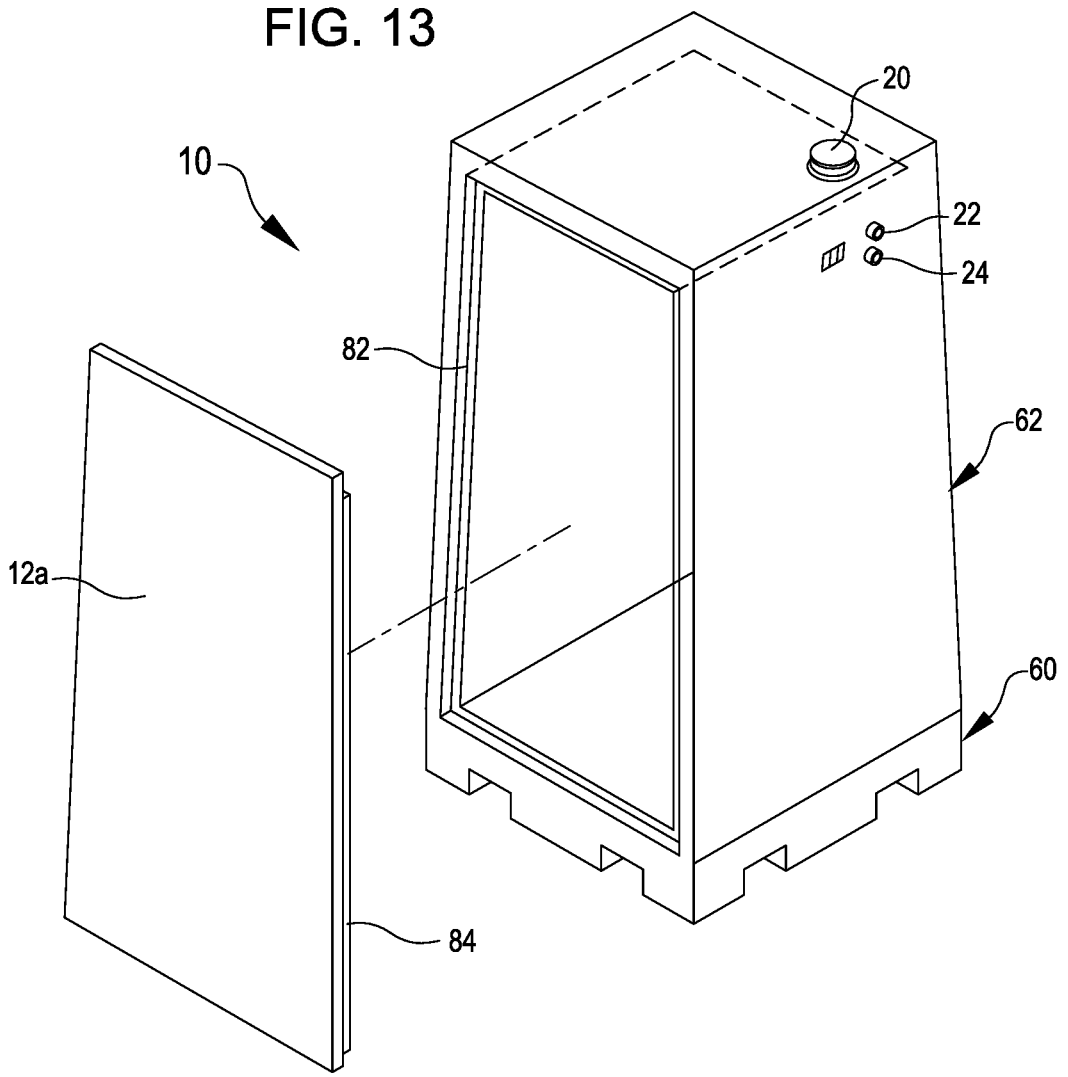
FIG. 13 is a perspective view of still another alternative embodiment transportable vacuum container wherein access is gained from the side.

FIG. 13 illustrates another alternative embodiment, similar to that shown in FIGS. 9-12 but wherein access to the interior of the transportable, vacuum container 10 is provided through the side of the overlying cover 62. In this embodiment, the top panel 16, bottom panel 60 and three side panels 12 of the container comprise a single unit, and a fourth side panel 12*a* is removable. Preferably, a rabbet 82 is formed around the periphery of the opening in the unitary structure to receive and support the removable side panel 12*a*. Preferably, one or more elastic seals 84 are provided between the edges of the removable panel 12*a* and the unitary structure to effectuate an air-tight seal when the removable panel is installed.

In the embodiment shown in FIG. 13 an internal bulkhead structure is preferably used in order to help resist the compressive forces experienced by the container when a vacuum is formed therein. Such as structure can be one such as has been described in connection with FIGS. 9 and 10. In addition, or in the alternative, internal stringers, such as those shown and described in connection with FIGS. 1-7 can be used to help resist such forces.

Figure 14:
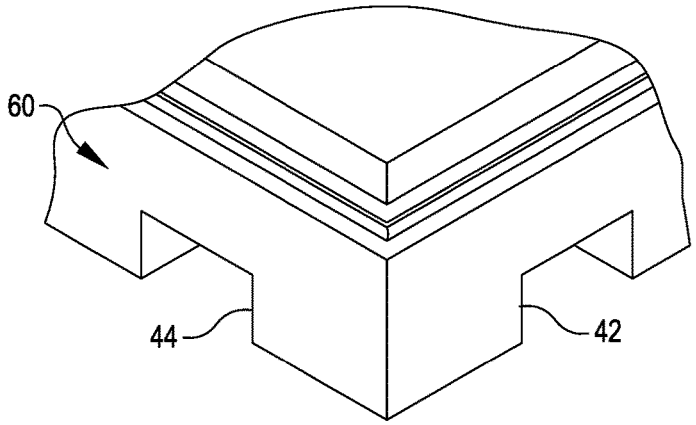
FIG. 14 is a partial perspective view of one arrangement for providing a vacuum seal between a bottom portion of a transportable vacuum container and an overlying cover.
Figure 15:
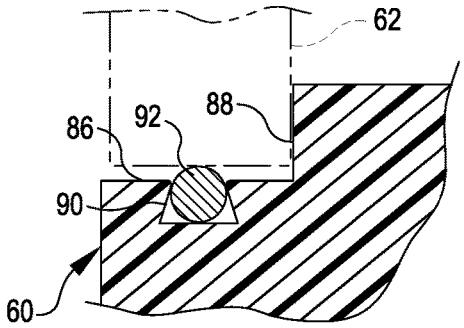
FIG. 15 is a partial sectional view showing the sealing arrangement shown in FIG. 14.

FIGS. 14 and 15 illustrate one arrangement for effectuating an air-tight vacuum seal where the overlying cover 62 meets the base 60 of a transportable vacuum container 10. In the embodiment shown in FIGS. 14 and 15, a rabbet is formed around the outer periphery of the upper surface of the base. This forms a horizontal wall or ledge 86 as well as a vertical wall 88 around the periphery of the base. The rabbet is dimensioned so as to closely receive the lower edge of the upper cover 62.

In the illustrated embodiment, a channel 90 is formed in the lower wall or ledge of the rabbet and a sealing element 92 is disposed within the channel. In the illustrated embodiment, the channel 90 is substantially dovetailed in cross-sectional shape to help retain the sealing element 92, although it will be appreciated that other shapes can be used. Again, the sealing element 92 can be made from any number of known elastomeric materials, such as rubber, silicone, or other polymer.

Figure 16:
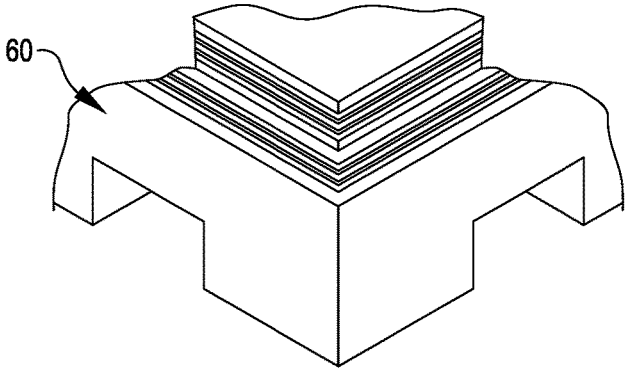
FIG. 16 is a partial perspective view of another arrangement for providing a vacuum seal between a bottom portion of a transportable vacuum container and an overlying cover.
Figure 17:
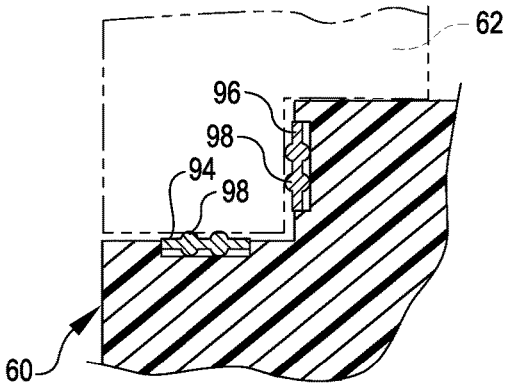
FIG. 17 is a partial sectional view showing the sealing arrangement shown in FIG. 16.

FIGS. 16 and 17 show another arrangement for forming an air-tight vacuum seal where the overlying cover 62 meets the base 60 of a transportable vacuum container 10. In this arrangement, separate sealing elements 94, 96 are provided in the horizontal and vertical walls 86, 88. In the illustrated embodiment, the seals 94, 96 are again preferably made of an elastomeric material, such as rubber, silicone or other polymer. In the illustrated embodiment, the seals 94 96 each comprise an elongated, generally flat strip with one or more integrally molded ridges 98 that closely contact the upper cover 62 and help effectuate a seal when the cover 62 is installed over the base 60. As further illustrated, each seal 92, 94 is received in a channel formed, respectively, in the horizontal and vertical walls 86, 88. It will be appreciated, however, that other means of mounting the sealing elements 94, 96 to the base 60, such as the dovetailed channel arrangement of FIGS. 14 and 15, can be used as well.

Figure 18:
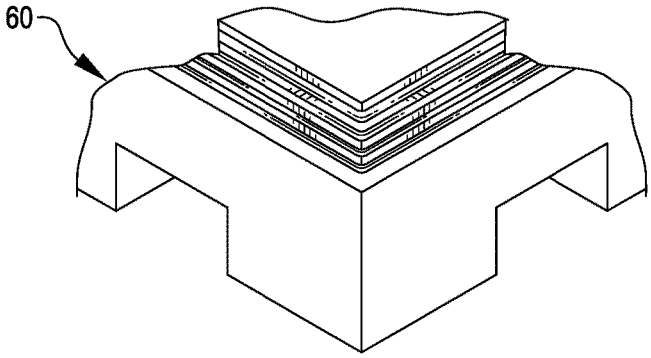
FIG. 18 is a partial perspective view of still another arrangement for providing a vacuum seal between a bottom portion of a transportable vacuum container and an overlying cover.
Figure 19:
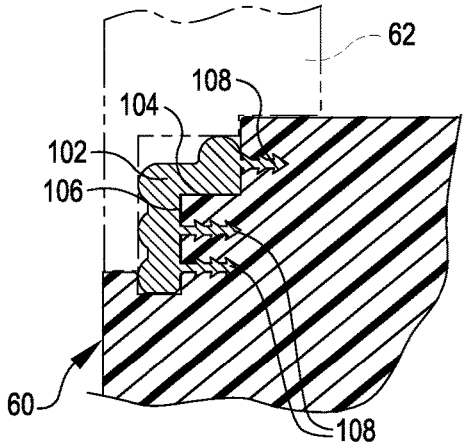
FIG. 19 is a partial sectional view showing the sealing arrangement shown in FIG. 18.

FIGS. 18 and 19 show still another arrangement for forming an air-tight vacuum seal where the overlying cover 62 meets the base 60 of the transportable vacuum container 10. In this arrangement, a unitary sealing element 100 is provided that forms a seal between overlying cover 62 and each of the horizontal and vertical walls 86, 88. As best seen in FIG. 19, rather than include a simple rabbet, the outer periphery of the base includes an intermediate step 102 that, in turn, form an intermediate ledge 104 and intermediate vertical wall 106. As further illustrated, the unitary sealing element 100 is generally L-shaped in cross section and is dimensioned to fit over the intermediate step 102. The lower edge of the overlying cover 62 is shaped in complementary fashion so as to closely engage the edge of the base 60 when installed. When the overlying cover 62 is installed, the sealing member 100 deforms to form an air-tight vacuum seal around the intermediate step 102. As further illustrated in FIG. 19, a plurality of outwardly projecting mounting tabs or ridges 108 are preferably integrally formed in the inner surfaces of the sealing member 102 and are received in complementary holes or recesses formed in the lower edge of the base 60. This arrangement makes it simple and easy to mount the sealing element 100 to the base 60 simply by pressing the mounting tabs 108 into the respective complementary holes. This also makes it easy to replace the seals in the field should a sealing element need to be renewed. Again, the seals 100 are preferably made of an elastomeric material, such as rubber, silicone or other polymer.

Figure 20:
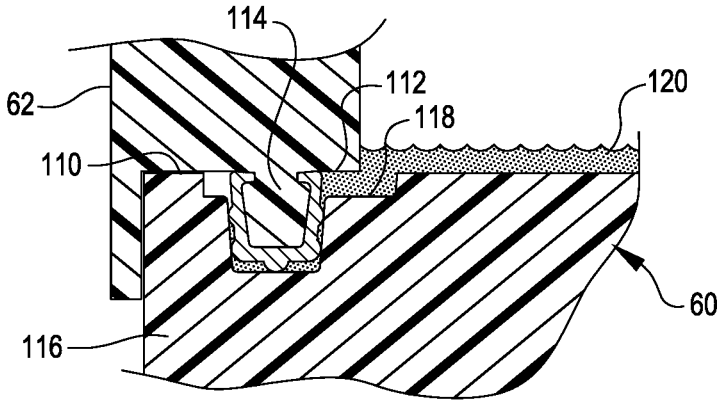
FIG. 20 is a partial sectional view of still another arrangement for effectuating a vacuum seal between a bottom portion of a transportable vacuum container and an overlying cover wherein water condensate is used to help effectuate the seal.

FIG. 20 illustrates still another arrangement for forming an air-tight vacuum seal where the overlying cover 62 meets the periphery of the base 60. In this arrangement, condensed water that accumulates within the chamber and collects on the upper surface of the base 60 is used to help effectuate the seal. As illustrated, the lower edge of the overlying cover 62 includes a first channel 110, spaced inwardly from the outer wall of the cover and a rabbet 112 formed along the inner edge of the cover. This forms a downwardly projecting ridge 114. A complementary channel 116 is formed in the upper surface of the base 60 spaced inwardly from the outer edge of the base. The complementary channel 116 is spaced and dimensioned to receive the downwardly projecting ridge 114 of the cover. A shallow channel 118 is also formed in the base inwardly of the complementary channel 116 and projects inwardly beyond the inner edge of the cover 62.

As further shown in FIG. 20, the outer edge of the base 60 is received in the first channel 110 formed in the lower edge of the overlying cover and contacts the bottom of the first channel to support the weight of the overlying cover. As further shown in FIG. 20, the dimensions of the complementary channel 116 formed in the base and the downwardly projecting ridge 114 of the cover are such that a small gap is maintained between the outer surfaces of the downwardly projecting ridge and the side and bottom walls of the channel. Condensed water 120 accumulating on the upper surface of the base 60 within the vacuum container flows through the rabbet 112 into the space between the downwardly projecting ridge 114 and the complementary channel 116 where it is trapped by the contact between the outer edge of the base and the first channel formed in the lower edge of the overlying cover. The water 120 thus trapped helps form a seal between the overlying cover 62 and the base 60 when the two components are joined to each other. In FIG. 20 the relative spacing between the ridges and channels of the overlying cover and the base have been exaggerated for clarity. In actual practice the parts would be more closely spaced than illustrated and the water seal would be thinner than shown.

Figure 21:
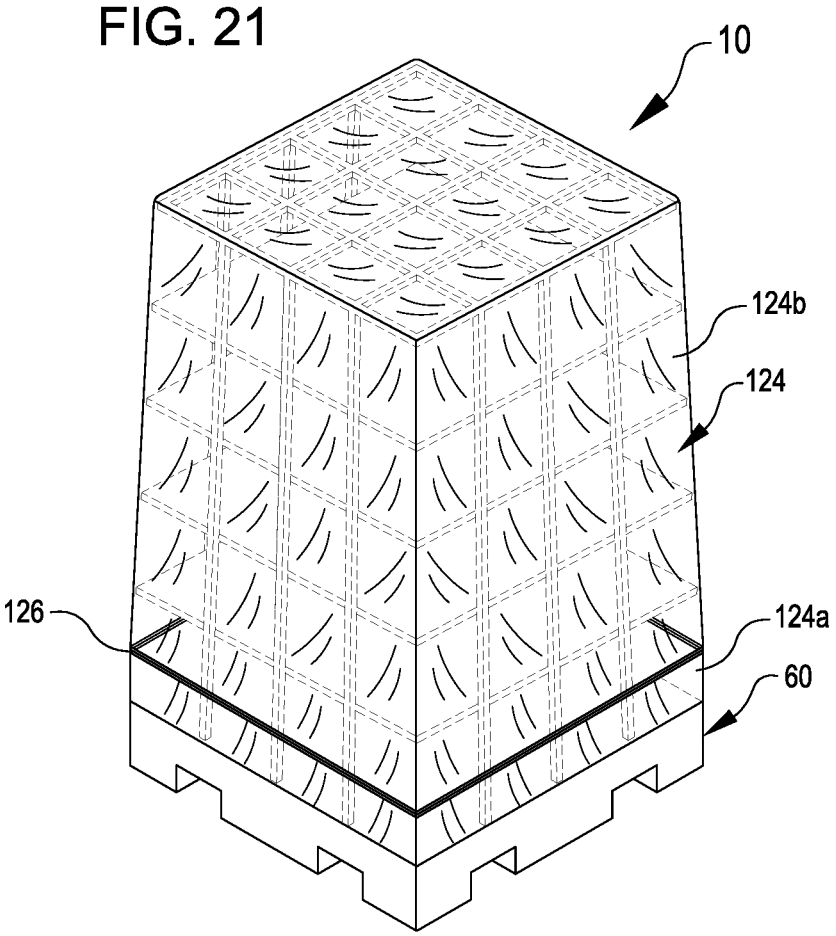
FIG. 21 is a perspective view of still another an alternative embodiment transportable vacuum container wherein a flexible bag is used to help effectuate the vacuum environment.
Figure 22:
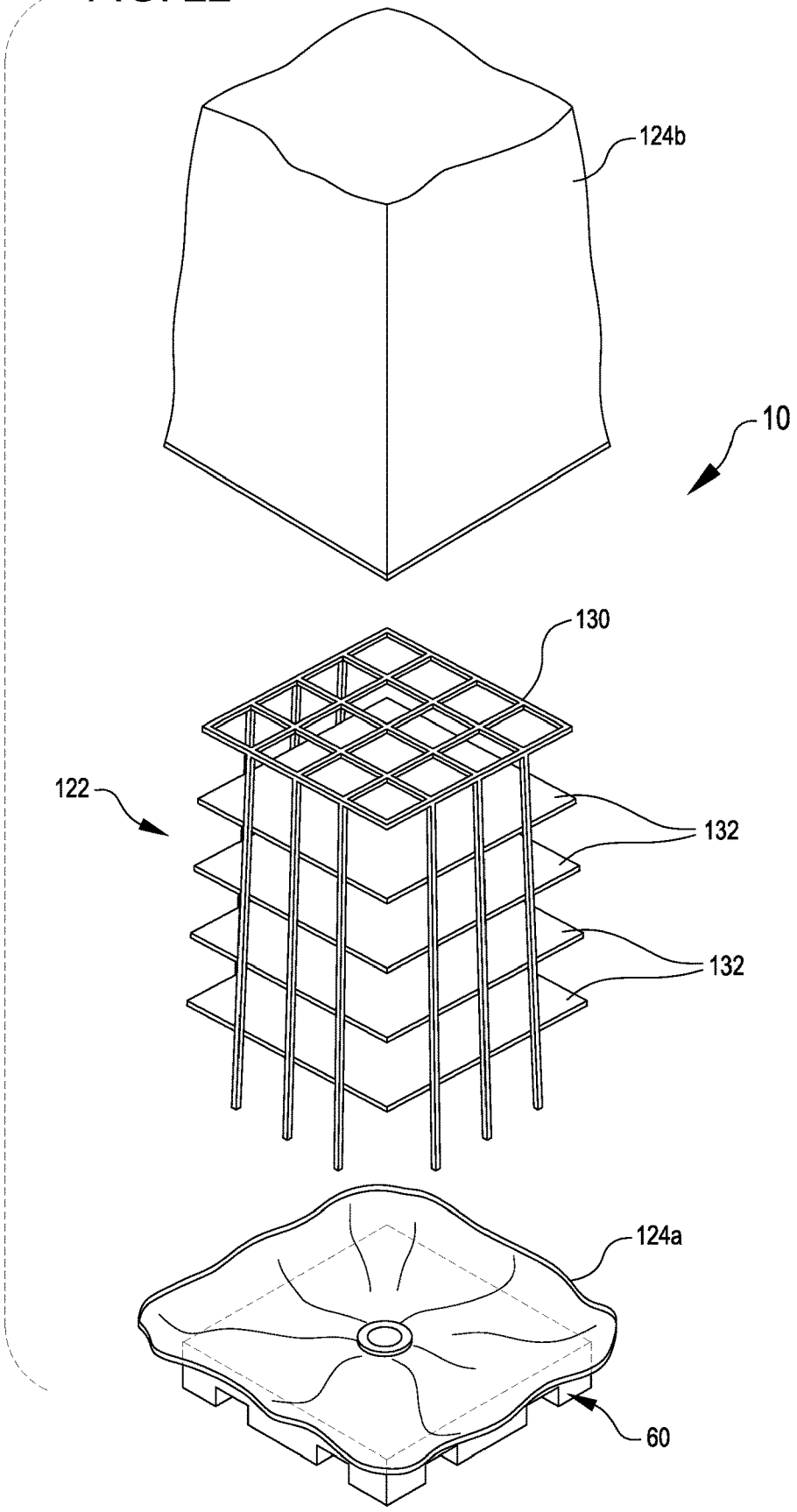
FIG. 22 is an exploded perspective view of the container shown in FIG. 21.

FIGS. 21 and 22 illustrate still another embodiment of transportable vacuum container 10 for holding perishable products under vacuum during transport and storage. In this embodiment, a base 60, substantially as shown and described earlier is provided. However, rather than use a rigid overlying cover as in the earlier described embodiments, in this embodiment a rigid interior structure 122 is provided for containing and holding the perishable products, and the vacuum is maintained by means of a flexible bag-like structure 124 that is placed and maintained around the interior structure 122 after the perishable products have been packed. The bag 124 can be formed of any number of flexible, gas-impermeable sheets or films such as polyethylene.

In the illustrated embodiment, the bag includes (1) a lower piece 124*a* that is placed over the base 60 and (2) an upper piece 124*b* that is placed over the interior structure 122. After packing, the upper piece 124*a* and lower piece 124*b* are joined and sealed to each other to form an air-tight chamber capable of holding a vacuum. The seal or joint 126 can be formed by any number of means, such as double-sided tape, adhesives of various sorts or by thermal or chemical welding.

As best seen in FIG. 22, the interior structure 122 preferably includes an exterior frame 130, formed of rigid plastic, metal or other stiff material. A plurality of spaced horizontal shelves 132 are supported by the exterior frame 130 and are positioned and shaped to hold and support the perishable products. The shelves 132 can be made of the corrugated plastics and/or aluminum honeycombed materials previously described.

In use, the lower piece of the bag 124*a* is placed over the top of the base 60 as best seen in FIG. 22. The interior structure 122 is then placed over the base 60 and lower piece of the bag 124*a* and the perishable products are loaded onto the shelves 132. When packing is complete, the upper piece of the bag 124*b* is then placed over the interior structure 122 and the upper and lower pieced 124*a* and 124*b* of the bag are joined to each other. Thereafter, a vacuum is formed within the bag. As the vacuum is formed, ambient air pressure pushes the bag against the interior structure. The interior structure 122, in turn, supports the bag 124 against further collapse. This embodiment has the advantage of avoiding the use of a reusable, relatively heavy overlying cover as the bags are relatively light-weight and can be utilized in a single-use manner. In other words, only the base 60 and the interior structure 122 are reused.

FIG. 23 illustrates in schematic form how the transportable vacuum containers can form a system and method for transporting and storing post-harvest fruits, vegetables and other perishable commodities under controlled atmospheric conditions. Utilizing the system and method, a plurality of transportable vacuum containers 10 are provided. The vacuum containers can be any of the types herein shown and described, and there is no requirement that each vacuum container be of any one particular embodiment. When packed with the perishable products, the plurality of vacuum containers are preferably coupled to a single control unit 140. The control unit 140 includes one or more vacuum pumps that are coupled to the vacuum containers by means of vacuum lines 142 and the apertures 22 in the containers. Preferably monitoring systems, for monitoring such parameters within the containers as pressure, humidity, gas concentrations, etc., are provided within the control unit and coupled to sensors within the chambers by means of the additional aperture(s) 24 in the containers 10. In use, the control unit 140, as well as the vacuum chambers 10 coupled thereto, are loaded into a shipping container, truck, rail car, ship or other vehicle whereby the perishable products can be transported under controlled atmospheric conditions. Power for operating the vacuum pump and monitoring systems can be provided externally from power supplied by the vehicle. Alternatively, power can be provided by means of batteries or other power sources contained in, or coupled to, the control unit. Preferably, a back-up power supply is provided in the control unit in the event main power to the system is lost. Monitor lights 146, 148 can also be provided on each vacuum unit to indicate normal operation (e.g. a green light) or a malfunction (e.g. a red light). Additionally, an audible alarm can be provided in the event of a system malfunction.

Still another embodiment of transportable vacuum container is illustrated in cross-section in FIG. 24. In this embodiment, the various apparatus for creating and maintaining the controlled atmospheric conditions are self-contained within the transportable vacuum container. As illustrated, a vacuum pump 150 for creating and maintaining a vacuum within the container is provided within the container, preferably mounted to the base 14. Similarly, monitoring and control circuitry 152 for monitoring and adjusting atmospheric parameters within the chamber 10 are provided. A battery or other power supply 154 for operating the vacuum pump, monitors and control circuitry is also provided. Finally, to ensure even distribution of whatever atmosphere remains in the container after the vacuum is formed, a fan 156 can be provided.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. A system for transporting perishable commodities under controlled atmospheric conditions comprising:

a plurality of movable containers for containing the perishable commodities; and a control unit coupled to the movable containers for creating and maintaining the controlled atmospheric conditions within the movable containers;

wherein each of the movable containers is formed from a non-metallic material, is substantially air-tight, and comprises a stringer, wherein the stringer allows the movable containers to withstand standard atmospheric air pressure when internal pressure within at least one of the movable containers is in a range between 5 and 180 torr without substantial collapse of such movable container, wherein each of the movable containers comprises a chamber portion and a removable cover portion for providing access to an interior of the chamber portion.

2. The system for transporting perishable commodities under controlled atmospheric conditions of claim 1 wherein the control unit includes a pump to reduce the internal pressure within the movable container to the range between 5 and 180 torr.

3. The system for transporting perishable commodities under controlled atmospheric conditions of claim 1, further comprising monitors for monitoring atmospheric conditions within the movable containers and wherein the control unit includes a control for modifying the atmospheric conditions within the movable containers in accordance with the atmospheric conditions sensed by said monitors.

4. The system for transporting perishable commodities under controlled atmospheric conditions of claim 1 wherein said control unit is operable from a primary power supply and includes a back-up power supply for continuing operation of the control unit.

5. The system for transporting perishable commodities under controlled atmospheric conditions of claim 1 wherein the movable containers and control unit are shaped and dimensioned to be received and contained within a standard shipping container.

6. The system for transporting perishable commodities under controlled atmospheric conditions of claim 1 wherein at least one of the plurality of movable containers or the control unit are configured for movement using a forklift.

7. The system for transporting perishable commodities under controlled atmospheric conditions of claim 1 wherein at least one of the plurality of movable containers or the control unit is a size of a pallet.

8. The system for transporting perishable commodities under controlled atmospheric conditions of claim 1 wherein the non-metallic material comprises at least one of polyethylene (PE), polypropylene (PP), polyethylene terephthalate (PET), or a fiber composite material.

9. The system for transporting perishable commodities under controlled atmospheric conditions of claim 1, wherein at least one of the movable containers further comprises a central support and wherein the removable cover portion of such movable container is supported against the standard atmospheric air pressure at least in part by the central support.

10. The system for transporting perishable commodities under controlled atmospheric conditions of claim 1, wherein at least one of the plurality of movable containers further comprises a bulkhead and wherein such bulkhead comprises an aperture through which a central support passes.

11. The system for transporting perishable commodities under controlled atmospheric conditions of claim 1, wherein at least one of the plurality of movable containers comprises a bulkhead and wherein the chamber portion comprises a ledge to support the bulkhead.

12. The system for transporting perishable commodities under controlled atmospheric conditions of claim 1, wherein the movable containers taper so that the movable containers, without the removable cover portion, can be nested into one another when not transporting perishable commodities.

13. The system for transporting perishable commodities under controlled atmospheric conditions of claim 1, wherein the chamber portion comprises the stringer.

14. The system for transporting perishable commodities under controlled atmospheric conditions of claim 1, wherein creating and maintaining a controlled atmosphere within the movable containers by the control unit comprises introducing or maintaining a level of at least one of oxygen, carbon dioxide, or fungicide within at least one of the moveable containers.

15. The system for transporting perishable commodities under controlled atmospheric conditions of claim 1, wherein a wall of each of the moveable containers comprises a thermally conductive material.

16. The system for transporting perishable commodities under controlled atmospheric conditions of claim 1, wherein at least one of the plurality of movable containers comprises a bulkhead and wherein the bulkhead extends from a first interior side to a second interior side of at least one of the movable containers.

17. The system for transporting perishable commodities under controlled atmospheric conditions of claim 1, wherein at least one of the plurality of movable containers comprise a bulkhead and wherein the bulkhead forms a shelf like structure to support the perishable commodities.

18. The system for transporting perishable commodities under controlled atmospheric conditions of claim 1, wherein at least one of the plurality of movable containers comprises a bulkhead and wherein the bulkhead is formed of a honeycombed or corrugated material.

19. The system for transporting perishable commodities under controlled atmospheric conditions of claim 1, wherein the plurality of movable containers contain the perishable commodities and wherein the perishable commodities comprise at least one of post-harvest fruits, vegetables, flowers, or uncooked meat or fish.

* * * * *